US010551773B2

(12) United States Patent
Takematsu et al.

(10) Patent No.: US 10,551,773 B2
(45) Date of Patent: Feb. 4, 2020

(54) CLEANING APPARATUS, AND FIXING APPARATUS USING SAME

(71) Applicant: CANON KABUSHIKI KAISHA, Tokyo (JP)

(72) Inventors: Koji Takematsu, Abiko (JP); Taiya Hirayama, Moriya (JP); Kenichi Tanaka, Ushiku (JP); Takeshi Kozuma, Abiko (JP); Atsushi Ishigami, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/927,908

(22) Filed: Mar. 21, 2018

(65) Prior Publication Data

US 2018/0284660 A1 Oct. 4, 2018

(30) Foreign Application Priority Data

Mar. 29, 2017 (JP) ..... 2017-064732
Jan. 22, 2018 (JP) ..... 2018-007936

(51) Int. Cl.
*G03G 15/20* (2006.01)
*G03G 15/00* (2006.01)

(52) U.S. Cl.
CPC ..... *G03G 15/2025* (2013.01); *G03G 15/5012* (2013.01); *G03G 15/5054* (2013.01); *G03G 2221/0015* (2013.01); *G03G 2221/0089* (2013.01)

(58) Field of Classification Search
CPC ..... G03G 15/5012; G03G 15/5054; G03G 15/2075
See application file for complete search history.

(56) References Cited

U.S. PATENT DOCUMENTS

2007/0217837 A1* 9/2007 Yamana ..... G03G 15/2053 399/328
2015/0234342 A1* 8/2015 Hatazaki ..... G03G 15/2075 399/327

(Continued)

FOREIGN PATENT DOCUMENTS

JP 06-194986 A 7/1994
JP 07-311517 A 11/1995
JP 2004-212409 A 7/2004

*Primary Examiner* — Walter L Lindsay, Jr.
*Assistant Examiner* — Jessica L Eley
(74) *Attorney, Agent, or Firm* — Canon Kabushiki Kaisha

(57) ABSTRACT

A cleaning apparatus and a fixing apparatus include a cleaning web configured to remove toner adhering to a rotation member, the cleaning web including a recessed portion in at least a part thereof, and a displacement mechanism configured to situate a relative position between the rotation member and a pressure member configured to press the cleaning web toward the rotation member at a first position where the cleaning web is pressed toward the rotation member by the pressure member and at a second position where the rotation member and the pressure member are farther from each other than at the first position. The displacement mechanism situates the relative position at the second position based on an output of a detection position configured to detect a position of the recessed portion, so that a rear end of the recessed portion is not pressed toward the rotation member by the pressure member.

18 Claims, 15 Drawing Sheets

(56) References Cited

U.S. PATENT DOCUMENTS

| | | | | |
|---|---|---|---|---|
| 2015/0253700 | A1* | 9/2015 | Hatazaki ..... | G03G 15/2039<br>399/327 |
| 2015/0253701 | A1* | 9/2015 | Hatazaki ..... | G03G 15/2025<br>399/327 |
| 2017/0242376 | A1* | 8/2017 | Tsujibayashi ..... | G03G 15/2032 |

* cited by examiner

CLEANING APPARATUS, AND FIXING APPARATUS USING SAME

BACKGROUND

Field of the Disclosure

The present disclosure relates to a cleaning apparatus and a fixing apparatus using the same, and relates to, for example, an image forming apparatus such as a copying machine, a facsimile, and a printer using an electrophotographic method.

Description of the Related Art

A fixing apparatus using a heat fixing method may cause an offset phenomenon in fixing a toner image to a recording material. The offset phenomenon refers to adhesion of part of the toner on the recording material to a fixing member (fixing roller). Residual toner remaining on the fixing roller can transfer to the subsequent recording material during fixing processing on the recording material. In particular, to a user who desires a high-quality output product, stain on the output product due to such offset toner is undesirable.

As a countermeasure, Japanese Patent Application Laid-Open No. 6-194986 discusses a fixing apparatus including a mechanism that brings a cleaning web for cleaning and removing residual toner from a fixing roller into contact with the fixing roller to clean the residual toner off the fixing member. Japanese Patent Application Laid-Open No. 2004-212409 discusses a fixing apparatus which collects residual toner on a fixing roller by a cleaning roller (collection roller) arranged between a cleaning web and the fixing roller, and cleans the collected toner off the cleaning roller with the cleaning web.

Japanese Patent Application Laid-Open No. 7-311517 discusses a fixing apparatus including a cleaning web in which a cutout is formed in a width direction. If a sensor flag to be guided by an edge of the cleaning web falls into the cutout, the fixing apparatus displays an advance end notice of the cleaning web to prompt replacement of the cleaning web.

However, if a cutout (recessed portion) is formed for the purpose of an advance end notice of the cleaning web, part of the cutout (recessed portion) may curl while the cutout is advanced to slide over the roller to be cleaned (fixing member, or cleaning member). If the cleaning web in such a state is nipped between the rollers, part of the cutout (recessed portion) may be folded to cause a rip of the cleaning web, starting from the cutout (recessed portion). In a worst case scenario, the ripped cleaning web may get caught in the rotation of the roller to be cleaned. The thinner the cleaning web, the more likely such a rip is to occur.

SUMMARY

The present disclosure is directed to a cleaning apparatus which suppresses a rip of a cleaning web, starting from a recessed portion of the cleaning web, and a fixing apparatus using the same.

According to an aspect of the present disclosure, a cleaning apparatus includes a rotation member, a cleaning web configured to remove toner adhering to the rotation member, the cleaning web including a recessed portion in at least a part thereof, a pressure member configured to press the cleaning web toward the rotation member, a moving mechanism configured to move the cleaning web so that the cleaning web is moved between the rotation member and the pressure member, a detection unit configured to detect a position of the recessed portion, and a displacement mechanism configured to situate a relative position between the rotation member and the pressure member at a first position where the cleaning web is pressed toward the rotation member by the pressure member and at a second position at which the rotation member and the pressure member are farther from each other than at the first position, wherein the displacement mechanism is configured to situate the relative position at the second position based on an output of the detection unit so that a rear end of the recessed portion is not pressed toward the rotation member by the pressure member.

According to another aspect of the present disclosure, a fixing apparatus includes first and second rotation members configured to form a first nip portion for fixing a toner image to a recording material, a third rotation member configured to make contact with the first rotation member, a cleaning web configured to remove toner adhering to the third rotation member, the cleaning web including a recessed portion in at least a part thereof, a pressure member configured to press the cleaning web toward the third rotation member, a moving mechanism configured to move the cleaning web so that the cleaning web is moved between the third rotation member and the pressure member, a detection unit configured to detect a position of the recessed portion, and a displacement mechanism configured to situate a relative position between the third rotation member and the pressure member at a first position where the cleaning web is pressed toward the third rotation member by the pressure member and at a second position at which the third rotation member and the pressure member are farther from each other than at the first position, wherein the displacement mechanism is configured to situate the relative position at the second position based on an output of the detection unit so that a rear end of the recessed portion is not pressed toward the third rotation member by the pressure member.

According to yet another aspect of the present disclosure, a cleaning apparatus includes a rotation member, a cleaning web configured to remove toner adhering to the rotation member, the cleaning web including a recessed portion in at least a part thereof, a pressure member configured to press the cleaning web toward the rotation member, a moving mechanism configured to move the cleaning web so that the cleaning web is moved between the rotation member and the pressure member, a detection unit configured to detect a position of the recessed portion, and a displacement mechanism configured to situate a relative position between the rotation member and the pressure member at a first position where a force acting on a nip portion formed by the cleaning web and the pressure member is a first force and at a second position where the force acting on the nip portion is a second force smaller than the first force, wherein the displacement mechanism is configured to, when a rear end of the recessed portion passes the nip portion, situate the relative position at the second position based on an output of the detection unit.

According to yet another aspect of the present disclosure, a fixing apparatus includes first and second rotation members configured to form a first nip portion for fixing a toner image to a recording material, a third rotation member configured to make contact with the first rotation member, a cleaning web configured to remove toner adhering to the third rotation member, the cleaning web including a recessed portion in at least a part thereof, a pressure member configured to press the cleaning web toward the third rotation member, a moving mechanism configured to move the cleaning web so that the cleaning web is moved between the third rotation member and the pressure member, a detection unit configured to detect a position of the recessed portion, and a displacement mechanism configured to situate a relative position between the third rotation member and the pressure member at a first position where a force acting on a second nip portion formed by the cleaning web and the pressure member is a first force and at a second position where the force acting on the second nip portion is a second force smaller than the first force, wherein the displacement mechanism is configured to, when a rear end of the recessed portion passes the second nip portion, situate the relative position at the second position based on an output of the detection unit.

Further features of the present disclosure will become apparent from the following description of exemplary embodiments with reference to the attached drawings.

DESCRIPTION OF THE EMBODIMENTS

Various exemplary embodiments of the present disclosure will be described in detail below with reference to the accompanying drawings.

(Image Forming Apparatus)

Figure 1:
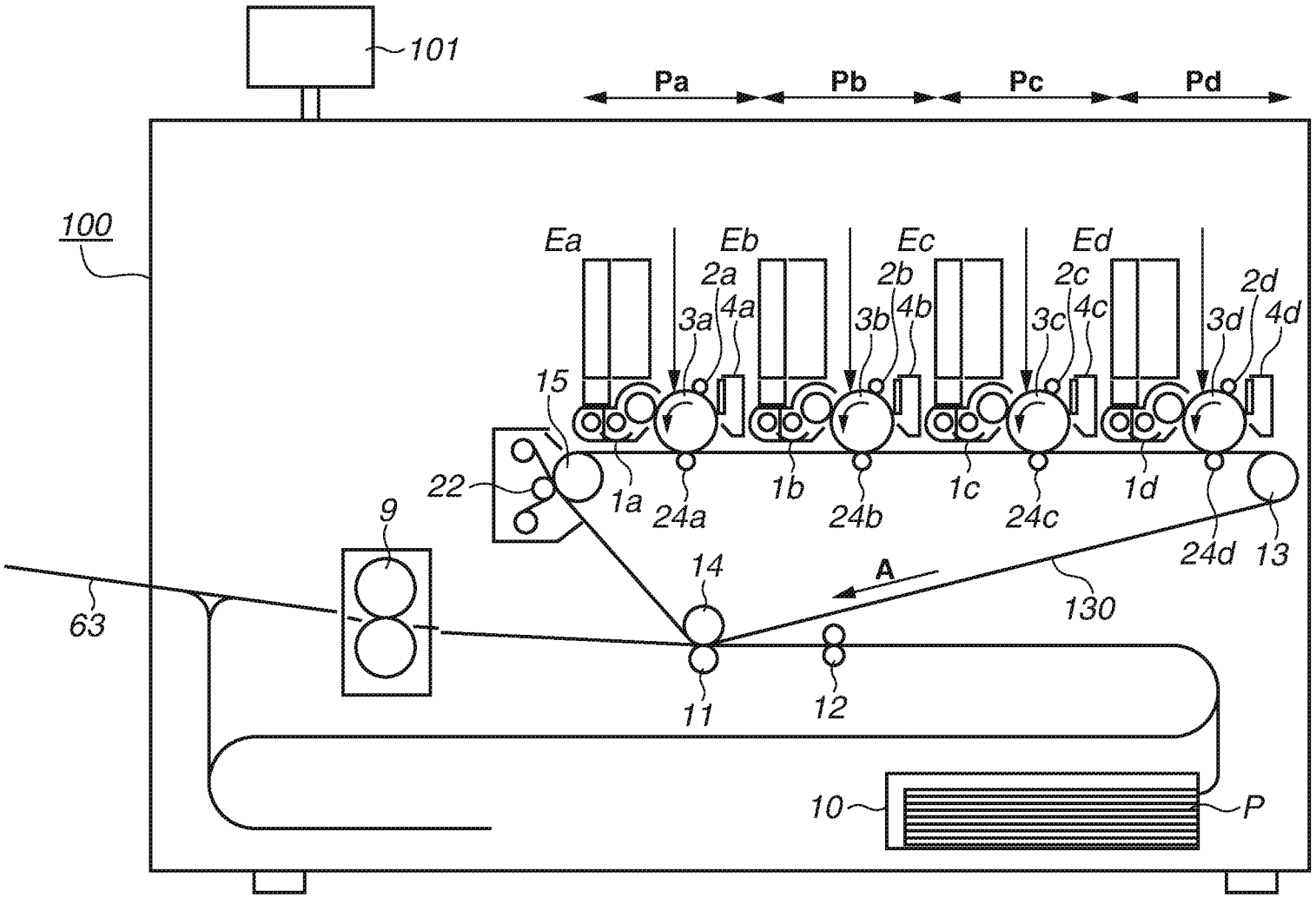
FIG. 1 is a sectional view illustrating an image forming apparatus which includes a fixing apparatus according to an exemplary embodiment of the subject disclosure.

FIG. 1 illustrates an image forming apparatus 100. A first, second, third, and fourth image forming units Pa, Pb, Pc, and Pd are arranged side by side in a main body of the image forming apparatus 100. Toner images of respective different colors are formed through the processes of latent image formation, development, and transfer. The image forming units Pa, Pb, Pc, and Pd include respective dedicated image bearing members, or in the present exemplary embodiment, electrophotographic photosensitive drums (hereinafter, photosensitive drums) 3*a*, 3*b*, 3*c*, and 3*d*. The toner images of respective colors are formed on the photosensitive drums 3*a*, 3*b*, 3*c*, and 3*d*.

An intermediate transfer member 130 is installed adjacent to the photosensitive drums 3*a*, 3*b*, 3*c*, and 3*d*. The toner images of respective colors formed on the photosensitive drums 3*a*, 3*b*, 3*c*, and 3*d* are primarily transferred to the intermediate transfer member 130, and transferred to a continuously-conveyed recording sheet P in a secondary transfer portion. The recording sheet P to which the toner images are transferred is heated and pressed by a fixing apparatus 9, whereby the toner images are fixed. The resulting recording sheet P is then output as a recorded image to outside the image forming apparatus 100.

Drum chargers 2*a*, 2*b*, 2*c*, and 2*d*, developing devices 1*a*, 1*b*, 1*c*, and 1*d*, primary transfer chargers 24*a*, 24*b*, 24*c*, and 24*d*, and cleaners 4*a*, 4*b*, 4*c*, and 4*d* are arranged around the photosensitive drums 3*a*, 3*b*, 3*c*, and 3*d*, respectively. Respective laser scanners are arranged in an upper part of the image forming apparatus 100. Each laser scanner includes a not-illustrated light source device and polygon mirror.

The polygon mirrors are rotated to perform scanning with laser light emitted from the light source devices. The beams of scanning light are deflected by reflection mirrors, and focused on the generatrices of the photosensitive drums 3*a*, 3*b*, 3*c*, and 3*d* by not-illustrated fθ lenses. Latent images according to an image signal are thereby formed on the photosensitive drums 3*a*, 3*b*, 3*c*, and 3*d*.

The developing devices 1*a*, 1*b*, 1*c*, and 1*d* are filled with a predetermined amount of cyan, magenta, yellow, and black toners serving as developers, respectively, by a not-illustrated supply device. The developing devices 1*a*, 1*b*, 1*c*, and 1*d* develop and visualize the latent images on the photosensitive drums 3*a*, 3*b*, 3*c*, and 3*d* into a cyan toner image, a magenta toner image, a yellow toner image, and a black toner image, respectively.

The toner used in the present exemplary embodiment contains (includes) paraffin, polyolefin wax, or silicone oil as a releasing agent. Specifically, in the present exemplary embodiment, pulverized toner in which a wax component and pigments are finely dispersed is used. Polymer toner containing such a wax component may be used. In the following description, an example of using wax as the releasing agent is described. The description also applies if silicone oil is used as the releasing agent as mentioned above.

The intermediate transfer member 130 is driven to rotate in the direction of the arrow A at the same circumferential speed as that of the photosensitive drums 3*a*, 3*b*, 3*c*, and 3*d*. The yellow, or first-color, toner image formed and borne on the photosensitive drum 3*a* is intermediately transferred to the outer peripheral surface of the intermediate transfer member 130 in the process of passing through a nip portion between the photosensitive drum 3*a* and the intermediate transfer member 130. For intermediate transfer, a primary transfer bias source applies an electric field to the intermediate transfer member 130.

A secondary transfer roller 11 is supported by bearings and arranged in parallel with the intermediate transfer member 130 to make contact with a lower surface portion of the intermediate transfer member 130. A secondary transfer bias source applies a desired secondary transfer bias to the secondary transfer roller 11. Composite color toner images transferred to the intermediate transfer member 130 in a superposed manner are transferred to the recording sheet P as follows: The recording sheet P is fed from a sheet cassette 10 so that the recording sheet P passes registration rollers 12 and a pre-transfer guide, and is carried into a contact nip between the intermediate transfer member 130 and the secondary transfer roller 11 at predetermined timing. At the same time, the secondary transfer bias is applied to the secondary transfer roller 11 from the secondary transfer bias source.

The secondary transfer bias transfers the composite color toner images from the intermediate transfer member 130 to the recording sheet P. The magenta or second-color toner image, the cyan or third-color toner image, and the black or fourth-color toner image are then similarly transferred to the intermediate transfer member 130 in a superposed manner in succession, whereby the composite color toner image corresponding to an intended color image is formed. The composite color toner image is formed to leave a certain margin from the four side edges of the recording sheet P. In the present exemplary embodiment, the margin at the front end is approximately 2 to 3 mm.

After the primary transfer, transfer residual toner on the photosensitive drums 3*a*, 3*b*, 3*c*, and 3*d* is cleaned and removed by the respective cleaners 4*a*, 4*b*, 4*c*, and 4*d*. The photosensitive drums 3*a*, 3*b*, 3*c*, and 3*d* are thereby made ready for the formation and other processes of a next latent image. Toner and other foreign substances remaining on the intermediate transfer member 130 are wiped off by bringing a cleaning web (unwoven fabric) into contact with the surface of the intermediate transfer member 130. The recording sheet P to which the composite color toner image is transferred is sequentially guided into the fixing apparatus 9, and the recording sheet P is heated and pressed so that the composite color toner image is fixed.

A monochrome image forming apparatus includes only the black image bearing member in the foregoing description. The toner image formed on the image bearing member is transferred to a recording material by a transfer device.

In the case of two-sided printing, the recording sheet P fed from the sheet cassette 10 passes the registration rollers 12, the pre-transfer guide, and the contact nip between the intermediate transfer member 130 and the secondary transfer roller 11. One side of the recording sheet P is fixed by the fixing apparatus 9, and then the recording sheet P is guided to a reversing path by a side flapper.

The recording sheet P is then reversed and guided into a two-sided path by a reversing roller. The recording sheet P then passes the registration rollers 12, the pre-transfer guide, and the contact nip between the intermediate transfer member 130 and the secondary transfer roller 11 again. A composite color toner image is transferred to the second side of the recording sheet P, and both sides are fixed by the fixing apparatus 9. The side flapper is switched while the image is being formed on both sides of the recording sheet P, and the recording sheet P, on both sides of which the image is fixed, is discharged out of the image forming apparatus 100 as a recorded image.

As will be described below, the fixing apparatus 9 included in the image forming apparatus 100 fixes, by application of heat and pressure, toner images that are formed on a recording material by using toner containing the foregoing releasing agent.

(Fixing Apparatus)

Figure 2:
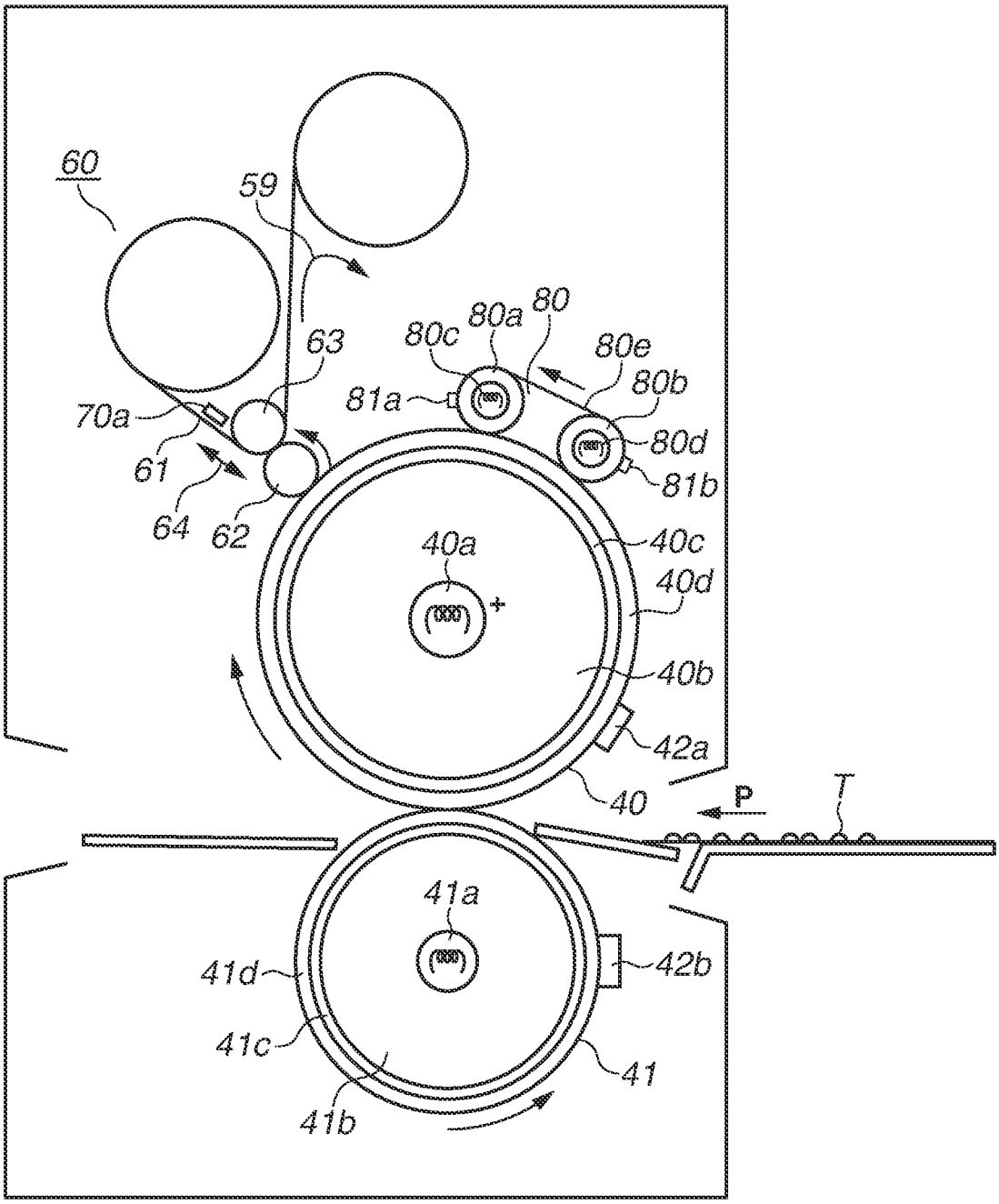
FIG. 2 is a sectional view illustrating a configuration of the fixing apparatus which includes a cleaning apparatus according to an exemplary embodiment of the subject disclosure.

FIG. 2 is an explanatory diagram of a specific configuration of the fixing apparatus 9 (FIG. 1) according to the present exemplary embodiment. As employed in the present exemplary embodiment, a longitudinal direction refers to a direction orthogonal to a conveyance direction of the recording material and a thickness direction of the recording material. A recording material (sheet) P bearing an unfixed toner image T is nipped and conveyed by a fixing nip portion (heating nip portion, or first nip portion) formed between a fixing roller (heating member, first fixing member, or rotation member) 40 to be contacted with an image surface and a pressure roller (pressure member, opposed member, second fixing member, or rotation member) 41. The unfixed toner image T is thereby fixed to the recording material P. In the present exemplary embodiment, the pressure roller 41 is pressed against the fixing roller 40 at a total pressure of approximately 784 N (approximately 80 kg), whereby the fixing nip portion of the recording material P is formed.

The fixing roller 40 is configured to have a diameter of 60 mm, with 3-mm-thick elastic layers 40*c* and 40*d* arranged on the outer peripheral surface of an aluminum cylinder core 40*b*. The underlayer 40*c* of the elastic layers 40*c* and 40*d* is a high temperature vulcanization (HTV) silicone rubber layer. A room temperature vulcanization (RTV) silicone rubber layer 40*d* serving as a heat-resistant elastic layer (releasing layer) to be contacted with an image surface is arranged on the outer peripheral surface of the HTV silicone rubber layer.

The pressure roller 41 is configured to have a diameter of 60 mm, with 1-mm-thick elastic layers 41*c* and 41*d* arranged on the outer peripheral surface of an aluminum cylinder core 41*b*. The underlayer 41*c* of the elastic layers 41*c* and 41*d* is an HTV silicone rubber layer. A fluorocarbon resin layer 41*d* serving as a releasing layer is arranged on the outer peripheral surface of the HTV silicone rubber layer.

A halogen heater 40*a* for heating the fixing roller 40 from inside is non-rotatably arranged at the rotation center of the fixing roller 40. A halogen heater 41*a* for heating the pressure roller 41 from inside is non-rotatably arranged at the rotation center of the pressure roller 41.

The fixing roller 40 and the pressure roller 41 are rotatably supported by ball bearings at both longitudinal ends. A gear is fixed to one axial end of each of the fixing roller 40 and the pressure roller 41. The gears are coupled by a not-illustrated gear mechanism and are integrally driven to rotate by a not-illustrated driving system, whereby the fixing roller 40 and the pressure roller 41 are rotated in the directions of the respective arrows.

An external heating device 80 illustrated in FIG. 2 includes an external heating belt 80*e* which is stretched across two external heating support rollers 80*a* and 80*b*. The external heating device 80 is intended to compensate for a lack of the amount of heat supplied from the heater 40*a* inside the fixing roller 40 and the heater 41*a* inside the pressure roller 41 with respect to heat deprived from the fixing nip portion by the recording material P. The external heating device 80 has a function of maintaining the surface temperature of the fixing roller 40 at or above a predetermined temperature. The external heating belt 80*e* is provided to form a wide nip portion with the fixing roller 40 and increase the amount of heat transferred.

The external heating device 80 can be detachably attached by an attaching and detaching mechanism (not illustrated)

which is detachably attachable to the fixing roller 40 as a whole. The external heating support rollers 80*a* and 80*b* and the external heating belt 80*e* are rotated in the direction of the arrow by a driving force transmitted from the fixing roller 40 only when the external heating belt 80*e* is brought into contact with and pressed against the fixing roller 40.

The external heating support rollers 80*a* and 80*b* are rotatably supported by ball bearings at both longitudinal ends. Halogen heaters 80*c* and 80*d* for heating the external heating support rollers 80*a* and 80*b* from inside are non-rotatably arranged at the rotation centers of the respective heating support rollers 80*a* and 80*b*. In the present exemplary embodiment, heaters having a rated power of 1500 W are used as the halogen heaters 80*c* and 80*d*.

When the external heating belt 80*e* is stopped, the halogen heaters 80*c* and 80*d* are controlled to be turned on or off so that the halogen heaters 80*c* and 80*d* are at a predetermined temperature based on output results of temperature detection elements 81*a* and 81*b*, respectively. If the external heating device 80 is contacted with the fixing roller 40 and the external heating belt 80*e* starts to be driven to rotate by the fixing roller 40, a central processing unit (CPU) (not illustrated) performs the following control. The halogen heaters 80*c* and 80*d* are controlled to be turned on or off according to the output value of only the temperature detection element 81*a* arranged upstream in the direction of rotation of the nip portion formed by the external heating belt 80*e* and the fixing roller 40. Even in such a case, the CPU continues constantly monitoring the output of the temperature detection element 81*b*.

A thermistor (temperature detection unit) 42*a* which makes contact with the surface of the fixing roller 40 is arranged upstream of the fixing nip portion and downstream of the external heating support roller 80*b* in the direction of rotation of the fixing roller 40. A not-illustrated temperature adjustment circuit (temperature adjustment unit) connected to the thermistor 42*a* adjusts power supplied to the halogen heater 40*a* so that the surface temperature of the fixing roller 40 detected by the thermistor 42*a* converges to a predetermined temperature (approximately 165° C.).

A thermistor (detection unit) 42*b* which makes contact with the pressure roller 41 is arranged upstream of the fixing nip portion in the direction of rotation of the pressure roller 41. A not-illustrated temperature adjustment circuit (temperature adjustment unit) connected to the thermistor 42*b* adjusts power supplied to the halogen heater 41*a* so that the surface temperature of the pressure roller 41 detected by the thermistor 42*b* concentrates on a predetermined temperature (approximately 140° C.).

The combination of the fixing roller 40 and the pressure roller 41 having the foregoing layer configurations further improves the releasability with respect to sharp melting toner. For the sake of fixing images on both sides, RTV or low temperature vulcanization (LTV) silicone rubber having a high toner releasing effect is used not only for the surface of the fixing roller 40 but for the surface of the pressure roller 41 as well.

(Cleaning Apparatus)

1) Basic Configuration

Figure 3A:
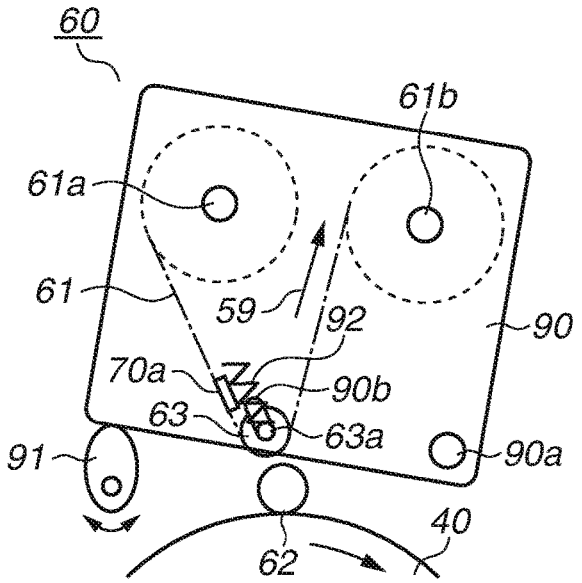
FIGS. 3A and 3B are schematic diagrams illustrating an attaching and detaching mechanism of a web unit according to an exemplary embodiment of the subject disclosure.
Figure 3B:
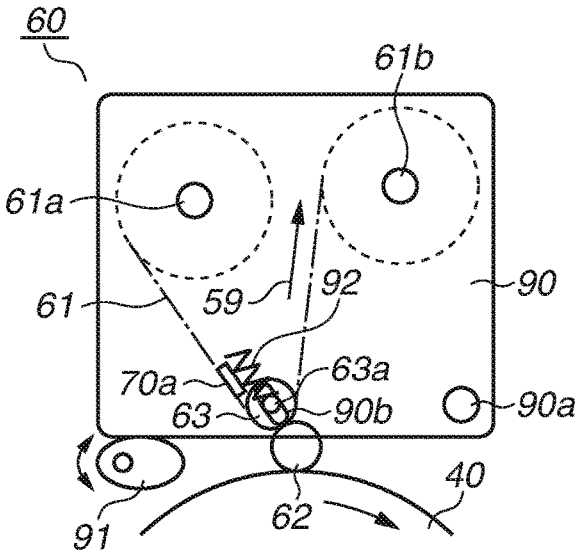

FIGS. 2, 3A, and 3B illustrate a web unit 60. The web unit 60 and a collection roller 62 constitute a cleaning apparatus as a cleaning mechanism of the fixing roller 40 according to the present exemplary embodiment. The web unit 60 includes a cleaning web (hereinafter, web) 61, the collection roller 62, and a web roller 63. The web 61 is made of unwoven fabric serving as a cleaning sheet. The collection roller 62 serves as a first rotation member. The web roller 63 serves as an opposed member (second rotation member, or pressure member) for the collection roller 62 and the web 61 to form a second nip portion with.

If toner exfoliates from a recording sheet P and offsets on the fixing roller 40 (needless toner adheres to the fixing roller 40), the collection roller 62 collects the offset toner. The collection roller 62 is constantly in contact with the fixing roller 40 for the purpose of collecting substance adhering to the surface of the fixing roller 40 even other than during image formation. In the present exemplary embodiment, the collection roller 62 is made of stainless steel SUS303, with an outer diameter of ϕ20 mm.

The web roller 63 serves as a pressure member (pressing member) and presses the web 61 against the collection roller 62. In the present exemplary embodiment, the web roller 63 can be displaced in the direction of the arrow 64 (FIG. 2). As will be described in detail below, the degree of pressing of the web roller 63 can be changed.

In FIGS. 3A and 3B, ends 63*a* of the web roller 63, ends of a supply roller 61*a*, and ends of a winding-up roller 61*b* at respective both longitudinal ends are installed on side plates 90 for rotatably supporting the rollers. The web 61 is configured to be rotatably supported and driven by the rollers. A new web 61 is initially installed. A web feed motor 210 (FIG. 8) for winding up the web 61 is installed on either one of the ends of the winding-up roller 61*b*, and the cleaning web 61 is gradually wound up in the direction of the arrow 59. The supply roller 61*a*, the winding-up roller 61*b*, and the web feed motor 210 function as a moving mechanism for moving the web 61 to between the collection roller 62 and the web roller 63.

2) Change Degree of Pressing

In the present exemplary embodiment, the web roller 63 can be displaced in the direction of the arrow 64 (FIG. 2) to change the degree of pressing (relative position) of the web roller 63 with respect to the collection roller 62 by using a pressing degree change unit (displacement unit, or displacement mechanism) including an attaching and detaching cam 91 and pressure springs 92. The degree of pressing of the web 61 with respect to the collection roller 62 can thus be changed.

More specifically, in the present exemplary embodiment, the relative position can be changed between a first position where a pressing force (strong pressure) for the web 61 to remove adhering substance is produced and a second position where the pressing force is zero (separated).

In the present exemplary embodiment, the side plates 90 are displaced to displace the web roller 63 in the direction of the arrow 64 (FIG. 2). In other words, not only the web roller 63 but the cleaning web 61, the web roller 63, the supply roller 61*a*, and the winding-up roller 61*b* are integrally moved.

Figure 8:
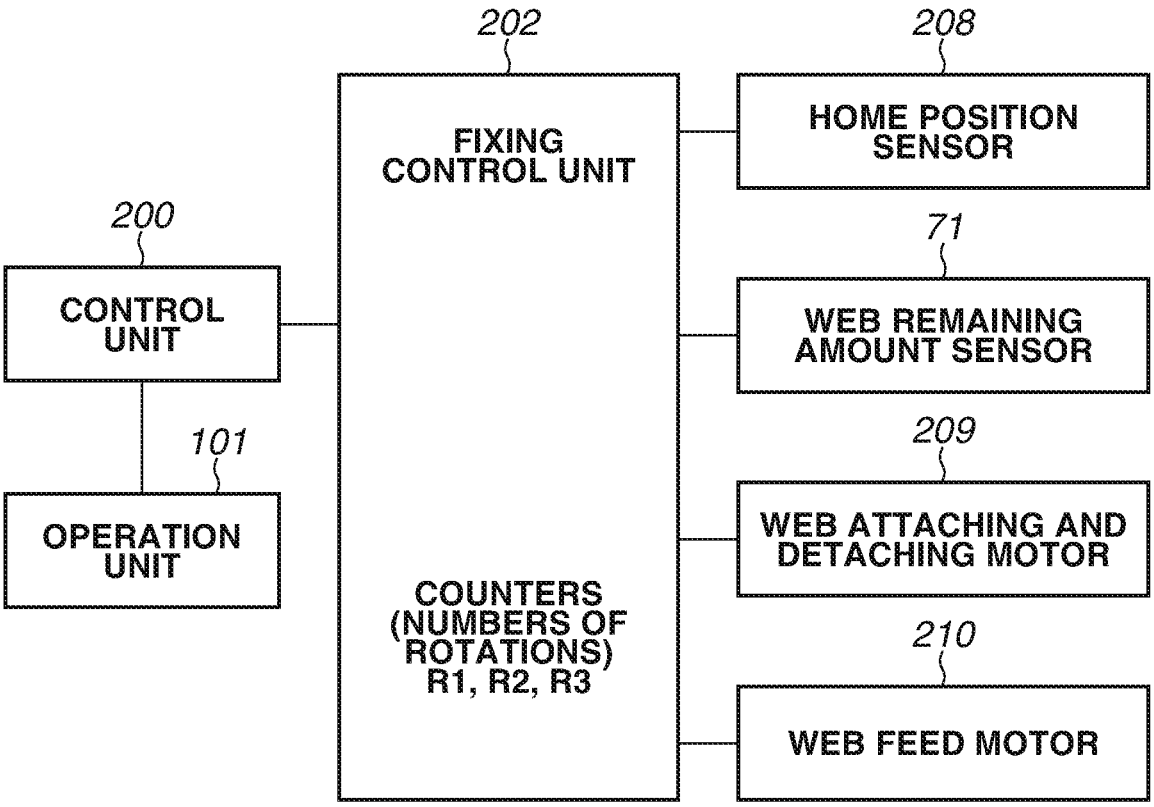
FIG. 8 is a block diagram according to the first exemplary embodiment of the subject disclosure.

Specifically, in FIGS. 3A and 3B, the web unit 60 implement contact (strong pressure), separation, and pressure reduction of the collection roller 62 and the web 61 by rotating the attaching and detaching cam 91 with a unit rotation support portion 90*a* as a rotation axis. FIG. 3A illustrates a separated state. FIG. 3B illustrates a strong pressure state. In a not-illustrated light pressure state, a rotation phase (rotation angle) of the attaching and detaching cam 91 comes to a state between those of FIGS. 3A and 3B. The rotation phase of the attaching and detaching cam 91 can be controlled by using a home position sensor 208 (FIG. 8).

As employed herein, the separated state refers to a state where the web roller 63 and the web 61 are separated from the collection roller 62. The light pressure state refers to a state where a load (force) acting on a nip portion N between the web roller 63 and the collection roller 62 is small (a second load (force) smaller than in the strong pressure state where the load (force) is a first load (force)). In the light pressure state, the web 61 is nipped between the web roller 63 and the collection roller 62. The strong pressure state refers to a state where the load (force) acting on the nip portion N between the web roller 63 and the collection roller 62 is large. In the strong pressure state, the web 61 is nipped between the web roller 63 and the collection roller 62.

The longitudinal ends 63*a* of the web roller 63 are supported to be rotatable and slidable in long holes 90*b* of the side plates 90 according to the rotation of the attaching and detaching cam 91. The sliding direction here is a direction orthogonal to the nip portion N between the web roller 63 and the collection roller 62. The longitudinal ends 63*a* of the web roller 63 are pressed toward the collection roller 62 by the pressure springs 92 fixed to the side plates 90. In the present exemplary embodiment, the pressure force of the pressure springs 92 is set to be 40 N when the web roller 63 comes into contact with the collection roller 62.

According to the rotation of the fixing roller 40, driving force is transmitted from the fixing roller 40 to the collection roller 62 which is constantly in contact with the fixing roller 40. This rotates the collection roller 62 which is supported by ball bearings that are supported to be movable toward the fixing roller 40. If the web 61 is in an off state (state where the web 61 is separated from the collection roller 62), the collection roller 62 presses the fixing roller 40 at a pressure of approximately 10 N by the own weight of the collection roller 62. The collection roller 62 is thus driven to rotate by the fixing roller 40 even in the state where the web 61 is off. If the web 61 is in the strong pressure state, the collection roller 62 presses the fixing roller 40 at a pressure of approximately 50 N including the additional pressing force of 40 N from the web 61.

If the web 61 is in the light pressure state, the pressing force of the web 61 is 10 N. The collection roller 62 presses the fixing roller 40 at a pressure of approximately 20 N including the additional pressure of approximately 10 N by the own weight of the collection roller 62.

In short, the pressing force acting between the collection roller 62 and the web 61 is 40 N during the strong pressure time, 10 N during the light pressure time, and 0 N (no load) when the collection roller 62 and the web 61 are separated.

The collection roller 62 is then driven by the fixing roller 40 to rotate according to the rotation of the fixing roller 40.

If the fixing roller 40 is driven to rotate in a state where the web roller 63 is on, the collection roller 62 rotates. The collection roller 62 collects toner on the fixing roller 40. The toner collected by and adhering to the collection roller 62 is cleaned by the web 61.

As described above, the web 61 cleans the residual toner off the fixing roller 40 via the collection roller 62. The cleaning web 61 in contact with the collection roller 62 is set to be gradually wound up by the winding-up roller 61*b* in the direction of the arrow 59 (FIGS. 2, 3A, and 3B) so that a new portion makes contact with the collection roller 62 before the cleaning web 61 is saturated with toner. The winding-up roller 61*b* is driven by the web feed motor 210 connected to the winding-up roller 61*b*, and thereby intermittently winds up the web 61. For example, the winding-up roller 61*b* repeatedly winds up the web 61 at a rate of once in several seconds during execution of a print job (while a recording sheet is passing).

An advance notice that "the remaining amount is small" needs to be issued to the user when there is still some amount of web 61 remaining. The reason is that the user may not be able to immediately replace the web 61 when the web 61 runs out. For example, suppose that a large number of sheets need to be passed at a time. If the user is not notified of no web until the web 61 runs out, and the passing of sheets is immediately disabled, the passing of sheets needs to be interrupted because of no web. Such an operation is inconvenient to the user. An advance notice that "the web is going to run out soon" is therefore desirably issued to the user before the web 61 runs out.

(Detection of Remaining Amount by Using Cutout)

Figure 4:
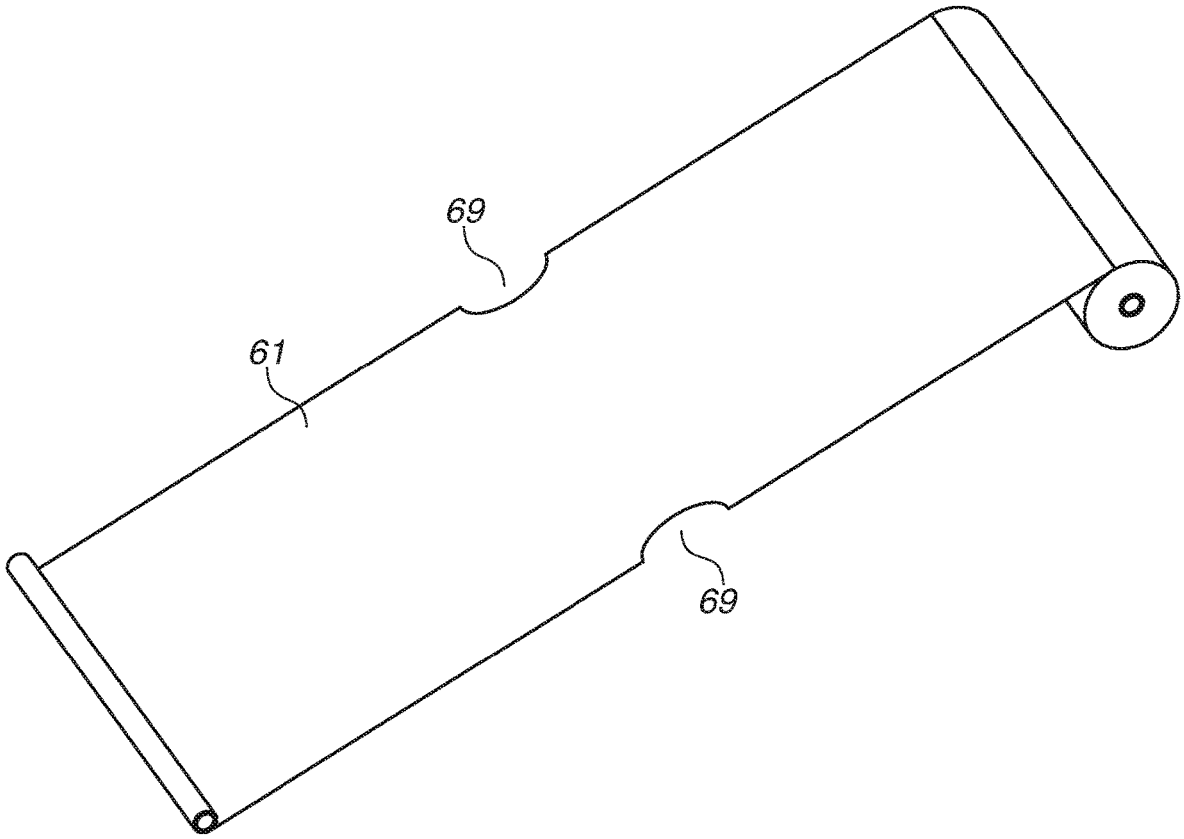
FIG. 4 is a schematic diagram illustrating a web according to an exemplary embodiment of the subject disclosure.

In the present exemplary embodiment, a cutout (recessed portion) 69 (FIG. 4) is formed in at least a part of the web 61 itself so that the remaining amount of the web 61 can be detected at a position somewhat before the web 61 runs out. A flag portion 70*a* of a web remaining amount detection flag 70 serving as a detection unit for detecting the cutout 69 is lightly placed on an edge of the upper surface of the web 61. As the web 61 is wound up by the winding-up roller 61*b*, the flag portion 70*a* approaches and falls into the cutout 69. If the flag portion 70*a* falls into the cutout 69, a flag portion 70*b* rotates for cutout detection. The cutout 69 may have any configuration in which the web remaining amount can be detected by the web remaining amount detection flag 70. For example, the cutout 69 may have a right-angled or obtuse-angled V shape. A method for detecting the small remaining amount of the web 61 will be specifically described below with reference to FIGS. 5A and 5B.

Figure 5A:
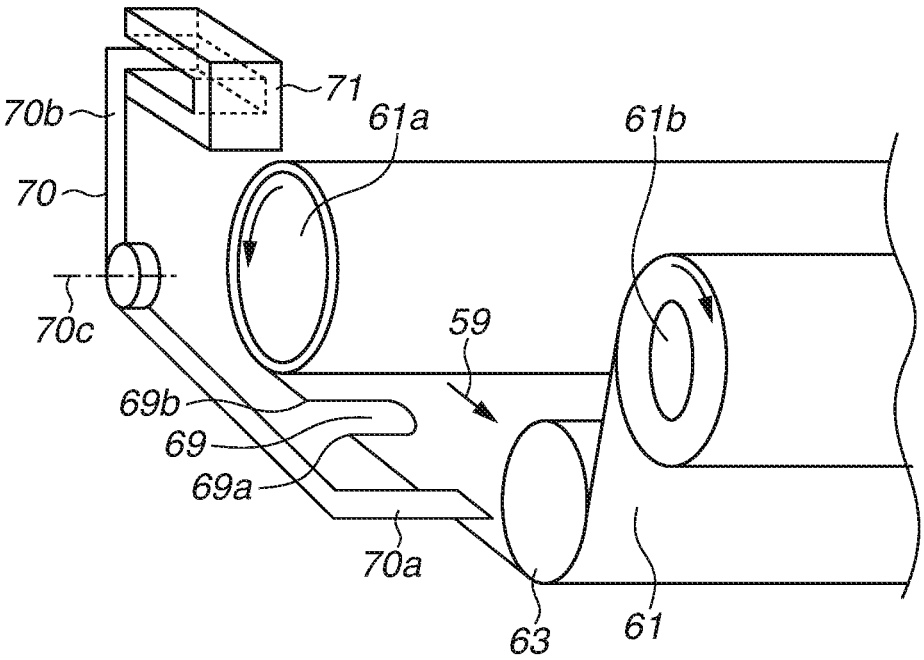
FIGS. 5A and 5B are diagrams for describing web remaining amount detection according to an exemplary embodiment of the subject disclosure.
Figure 5B:
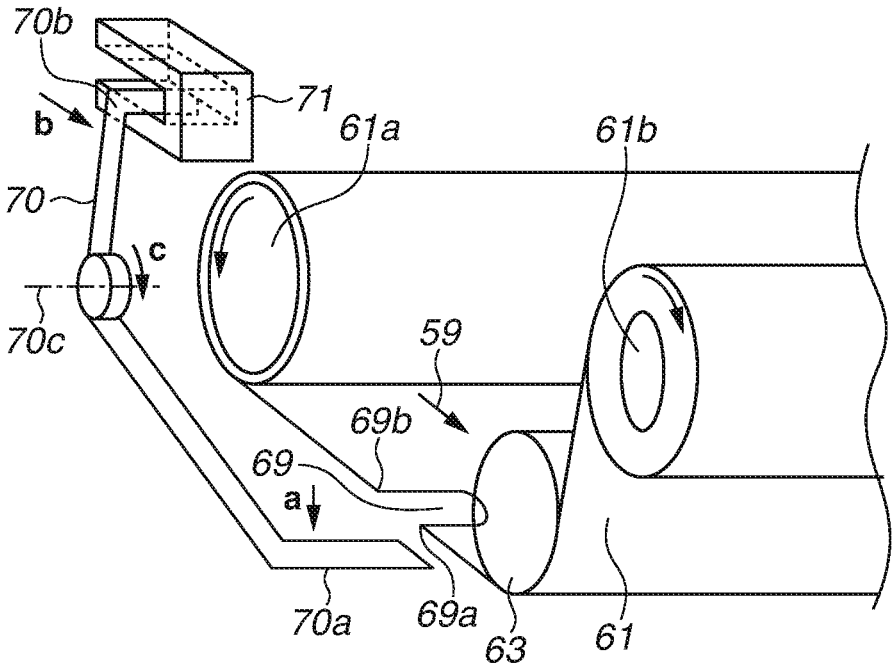

As illustrated in FIGS. 5A and 5B, the web remaining amount detection flag 70 and a remaining amount detection sensor (remaining web detection sensor) 71 for detecting that the web 61 is going to be fully wound up soon are arranged near one edge of the web 61 in the width direction. The web remaining amount detection flag 70 and the remaining amount detection sensor 71 are arranged upstream of the web roller 63 in the feeding direction of the web 61. The web remaining amount detection flag 70 is configured so that the flag portions 70*a* and 70*b* swing about an axis 70*c*. As illustrated in FIG. 5A, one of the flag portions, 70*a*, is lightly placed on the edge of the upper surface of the cleaning web 61. The web remaining amount detection flag 70 and the remaining amount detection sensor 71 function as a detection unit for detecting the position of the cutout 69 of the web 61. In the present exemplary embodiment, the web remaining amount detection flag 70 and the remaining amount detection sensor 71 detect that the cutout 69 reaches a predetermined position.

The cutout 69 is formed in the edge of the web 61 on the side where the flag portion 70*a* is placed, near the end of winding. As the web 61 is wound up and the remaining amount of the web 61 decreases, the cutout 69 and the flag portion 70*a* approach as illustrated in FIG. 5B, and the flag portion 70*a* falls in the direction of the arrow a.

As a result, the entire web remaining amount detection flag 70 rotates in the direction of the arrow c, and the other flag portion 70*b* moves in the direction of the arrow b (FIG. 5B). Here, the flag portion 70*b* crosses the remaining amount detection sensor 71, whereby remaining amount advance notice detection of the web 61 is performed. In the present exemplary embodiment, for example, a control unit 200 displays on a display unit of an operation unit 101 a message indicating that the remaining amount of the web 61 is small.

(Cleaning Web Remaining Amount Detection (Web Remaining Amount Detection) Sequence)

Figure 6A:
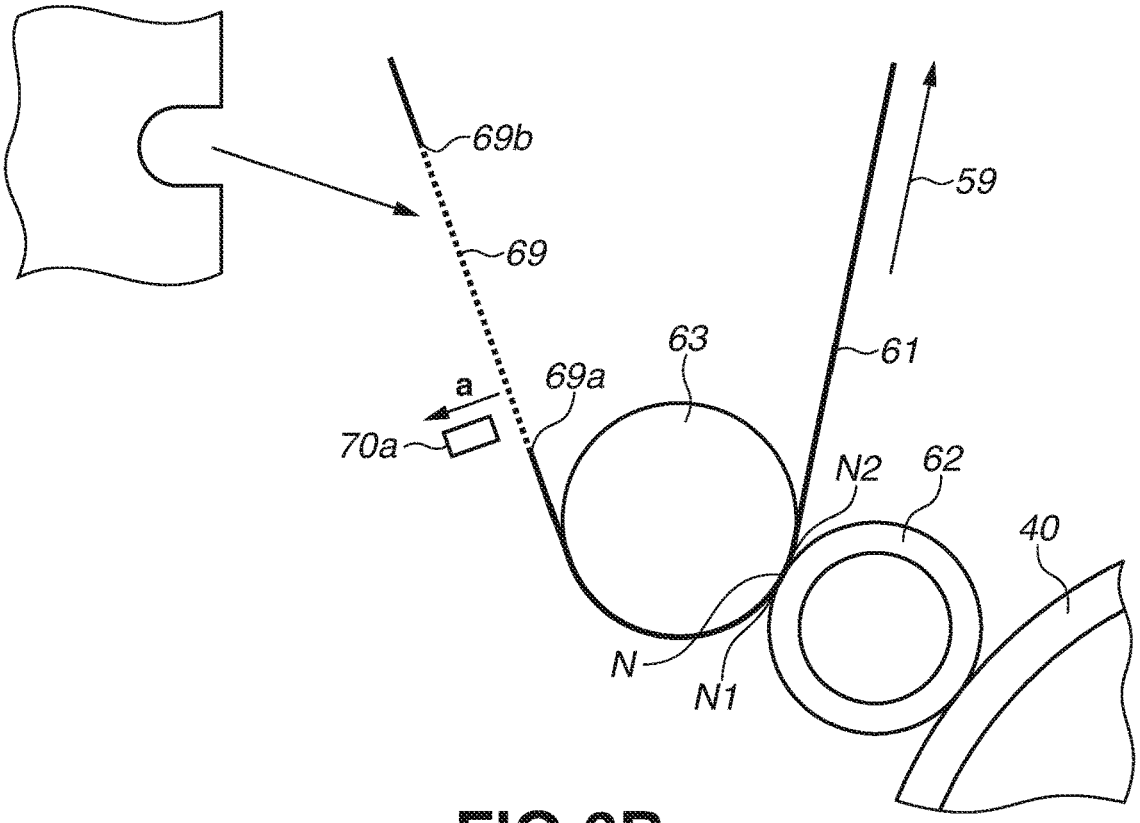
FIGS. 6A and 6B are diagrams for describing a web attaching and detaching operation according to a first exemplary embodiment of the subject disclosure.

Next, an operation sequence of the cleaning mechanism 60 during web remaining amount detection (during detection of the cutout 69 of the web 61) which is characteristic of the present exemplary embodiment will be described with reference to FIGS. 6A, 6B, 7A, and 7B. In FIGS. 6A and 7B, the nip portion N is formed between the collection roller 62 and the web roller 63 when the collection roller 62 is cleaned by the web 61. An inlet N1 of the nip portion N is the upstream end of the nip portion N in the moving direction of the web 61 (the direction of the arrow 59). An outlet N2 of the nip portion N is the downstream end of the nip portion N in the moving direction of the web 61 (the direction of the arrow 59).

As illustrated in FIG. 5B, if the flag portion 70*a* serving as the detection unit for detecting the cutout 69 reaches a front end 69*a* of the cutout 69 and falls in the direction of the arrow a, the remaining amount detection sensor 71 performs the remaining amount advance notice detection of the web 61 (FIG. 6A). After the remaining amount advance notice detection, the control unit 200 stops the print job. More specifically, according to the fact that at least the detection flag 70*a* serving as the detection unit detects the cutout 69, the control unit 200 suspends the conveyance of the recording material P, so that the recording material P does not pass the first nip portion (fixing nip portion) during a predetermined period including a period in which a rear end 69*b* of the cutout 69 passes between the collection roller 62 and the web roller 63 (area corresponding to the second nip portion).

Figure 6B:
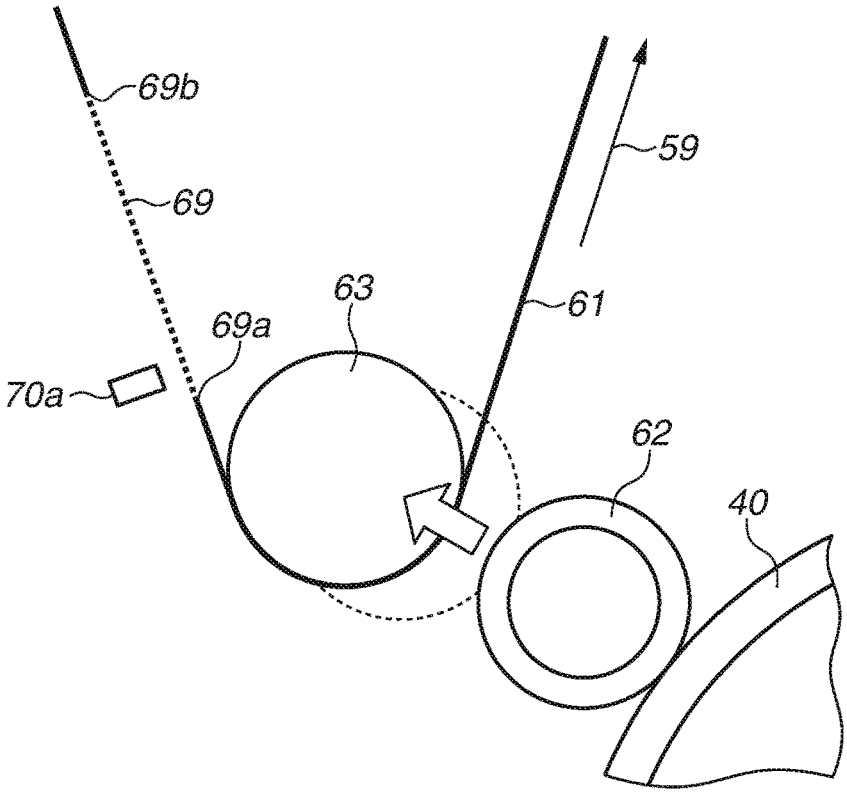

In the web unit 60, a web attaching and detaching motor 209 (FIG. 8) rotates to rotate the attaching and detaching cam 91, whereby the web roller 63 and the web 61 are separated from the collection roller 62 (FIG. 6B). As a result, the rear end 69*b* of the cutout 69 of the web 61 can pass between the collection roller 62 and the web roller 63 without being pressed between the collection roller 62 and the web roller 63. Here, stopping the print job refers to suspending the conveyance of the recording sheet P to the fixing nip portion N (in other words, increasing a sheet interval). When the web 61 is separated from the collection roller 62, the web 61 is unable to clean the collection roller 62. The suspension of the print job can suppress adhesion of offset toner stains to the output product because the web 61 is not able to clean the collection roller 62.

Figure 7A:
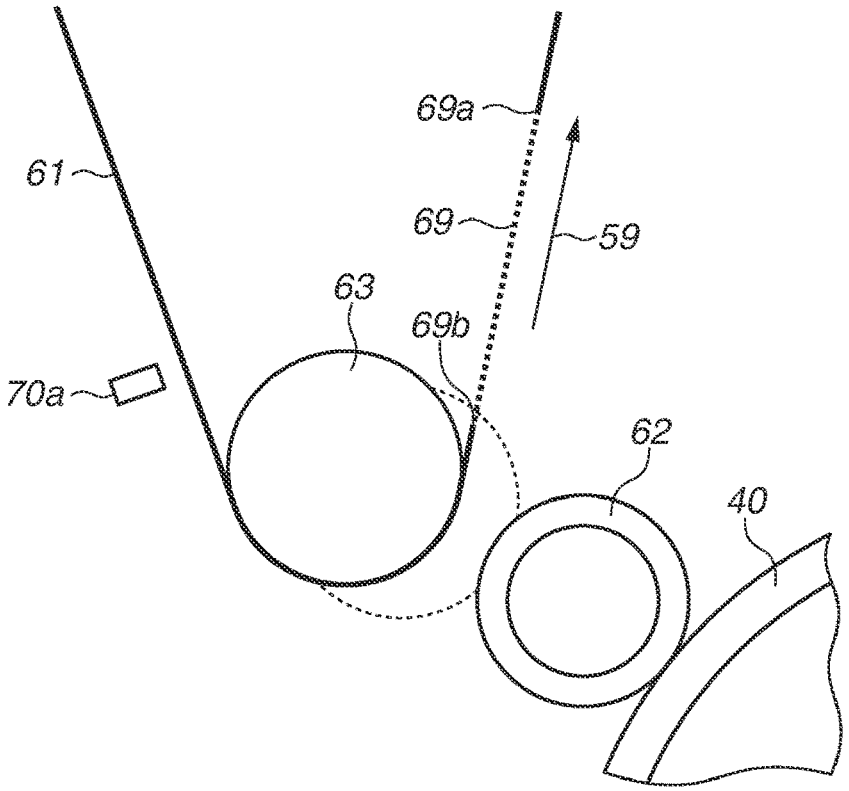
FIGS. 7A and 7B are diagrams for describing the web attaching and detaching operation according to the first exemplary embodiment of the subject disclosure.
Figure 7B:
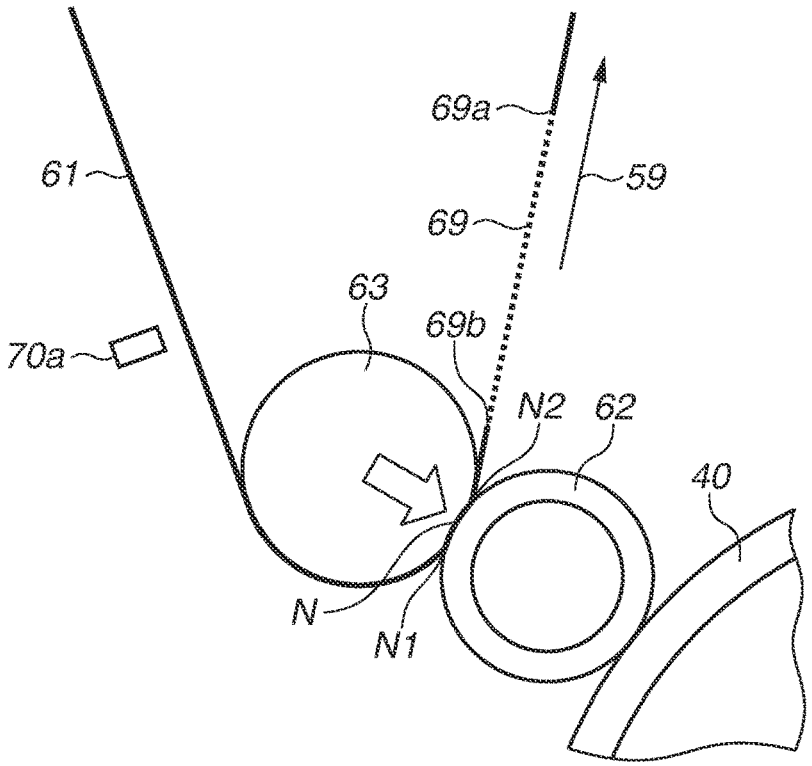

Then, the web feed motor 210 (FIG. 8) is rotated a predetermined number of rotations (R1 rotations), whereby the rear end 69*b* of the cutout 69 is advanced to a position surely beyond the outlet N2 of the nip portion N between the web roller 63 and the collection roller 62 (FIG. 7A). In the present exemplary embodiment, the number of rotations R1 of the web feed motor 210 controlled by a fixing control unit 202 (FIG. 8) is equivalent to a web feed amount of 100 mm which is needed for the rear end 69*b* of the cutout 69 to surely go beyond the outlet N2 of the nip portion N. As illustrated in FIGS. 5A and 5B, the rear end 69*b* of the cutout 69 of the web 61 is the downstream end of the rim of the recessed shape constituting the cutout 69 in the moving direction of the web 61 (the direction of the arrow 59). As illustrated in FIGS. 5A and 5B, the widthwise edges of the web 61 excluding the cutout 69 extend straight. The rear end 69*b* refers to the point where the rim of the cutout 69 intersects with the straight edge of the web 61 extending downstream of the cutout 69 in the moving direction (the direction of the arrow 59).

The web attaching and detaching motor (209) then rotates to rotate the attaching and detaching cam 91. The collection roller 62 and the web roller 63 nip the web 61 therebetween (strong pressure state) (FIG. 7B), and the print job is resumed.

FIG. 8 is a block diagram related to a contact and separation control on the collection roller 62 of the web unit 60 according to the present exemplary embodiment, and control for performing a feed operation of the web 61. In FIG. 8, the control unit 200 (for example, CPU) controls the entire image forming apparatus 100. The fixing control unit 202 (for example, CPU) controls the fixing apparatus 9. The control unit 200 and the fixing control unit 202 may be constituted by one CPU, or constituted by respective different CPUs. The control unit 200 and the fixing control unit 202 may include a plurality of CPUs each. In the following flowchart, the control unit 200 is described to control the fixing control unit 202 and other components.

Figure 9:
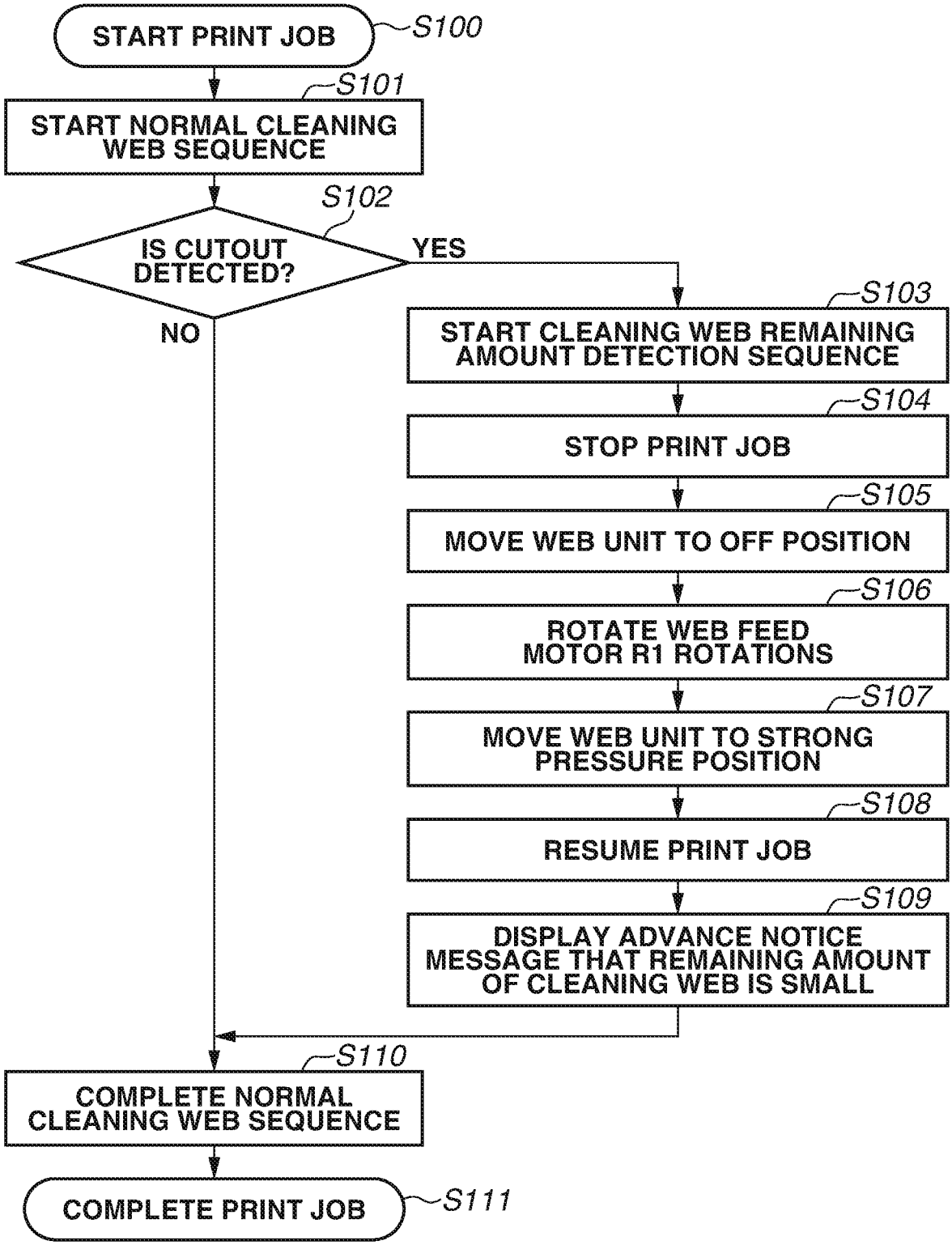
FIG. 9 is a flowchart according to the first exemplary embodiment of the subject disclosure.

FIG. 9 is a flowchart for performing the web remaining amount detection sequence. In step S100, a print job is started. In step S101, the control unit 200 starts a normal web sequence (normal cleaning web sequence). The control unit 200 then feeds the web 61 while the web 61 cleans toner collected from the fixing roller 40 off the collection roller 62. In step S102, if the cutout 69 of the web 61 is not detected by the remaining amount detection sensor 71 (NO in step S102), the processing proceeds to step S110. In step S110, the control unit 200 continues the normal web sequence until the normal web sequence is completed. In step S111, the control unit 200 completes the print job.

In step S102, if the cutout 69 of the web 61 is detected by the remaining amount detection sensor 71 (YES in step S102), the processing proceeds to step S103. In step S103, the control unit 200 starts a cleaning web remaining amount detection sequence. In step S104, the control unit 200 stops the print job. In step S105, the control unit 200 rotates the web attaching and detaching motor 209 (FIG. 8) to move the web unit 60 from a strong pressure position (first position) to an off position (separated position, or second position).

In step S106, the control unit 200 rotates the web feed motor 210 (FIG. 8) R1 rotations. In step S107, the control unit 200 rotates the web attaching and detaching motor 209 (FIG. 8) to move the web unit 60 from the off position (second position) to the strong pressure position (first position). In step S108, the control unit 200 resumes the print job. In step S109, the control unit 200 displays, on the not-illustrated operation unit, an advance notice message that the remaining amount of the web 61 is small. Here, the control unit 200 functions as a notification unit for making a notification about the remaining amount of the web 61. In step S110, the control unit 200 continues the normal cleaning web sequence until the normal cleaning web sequence is completed. In step S111, the control unit 200 completes the print job.

In the present exemplary embodiment, the web roller 63 and the collection roller 62 are separated at the nip portion N at the stage where the web remaining amount detection flag 70 has passed the cutout 69 of the web 61. The web 61 is advanced (wound up) until the cutout 69 passes the nip portion N. After the rear end 69*b* of the cutout 69 passes the nip portion N, the web 61 is brought into contact with the collection roller 62 (strong pressure state) again. This can suppress a rip starting at the cutout 69. As a result, desired cleaning performance can be provided.

In the present exemplary embodiment, the separation of the web 61 and the collection roller 62 in association with the cutout detection can also suppress adhesion of the web 61 to the collection roller 62.

In the present exemplary embodiment described above, the cutout 69 of the web 61 is described to be advanced by a predetermined amount with the web 61 separated. However, the occurrence of a rip can be similarly suppressed by bringing the web 61 into the light pressure state. A sequence for reducing the pressure may therefore be used instead of separating the web 61.

In other words, to change the degree of pressing, the relative position between the web roller 63 and the collection roller 62 may be changeable between the first position where the pressing force (strong pressure) for the web 61 to remove adhering substance is produced and the second position where the pressing force is weaker (light pressure) than that at the first position or the pressing force is zero (separated).

A second exemplary embodiment of the present disclosure will be described. In the first exemplary embodiment, the print job is stopped if the cutout 69 is detected as the detection of the remaining amount of the web 61. In the present exemplary embodiment, the print job is not stopped but continued until the front end 69*a* of the cutout 69 moves from the position of the remaining amount detection to a position immediately before the front end 69*a* is inserted into the inlet N1 of the nip portion N.

Figure 10A:
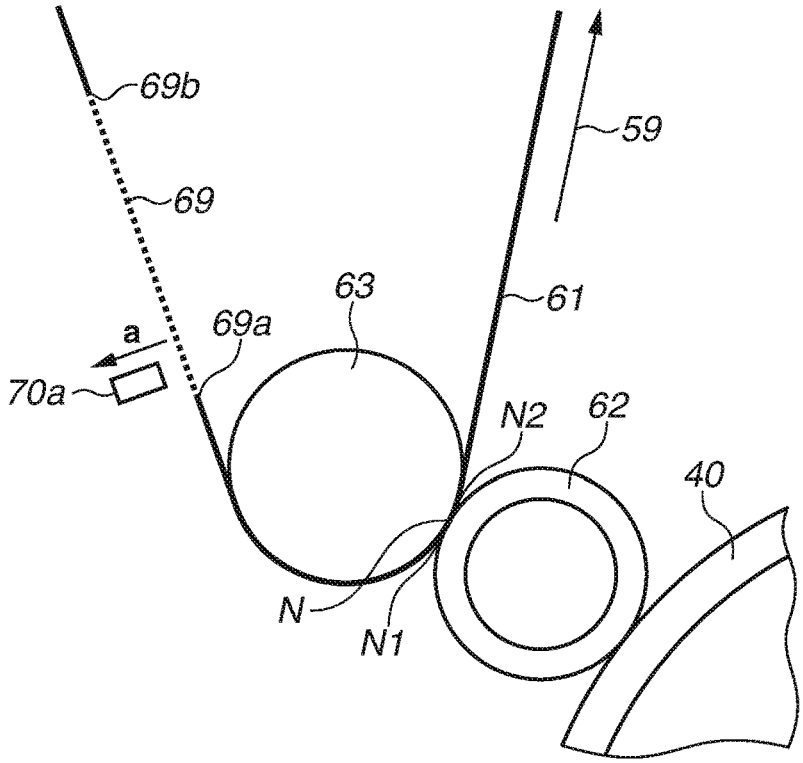
FIGS. 10A and 10B are diagrams for describing a web attaching and detaching operation according to a second exemplary embodiment of the subject disclosure.
Figure 10B:
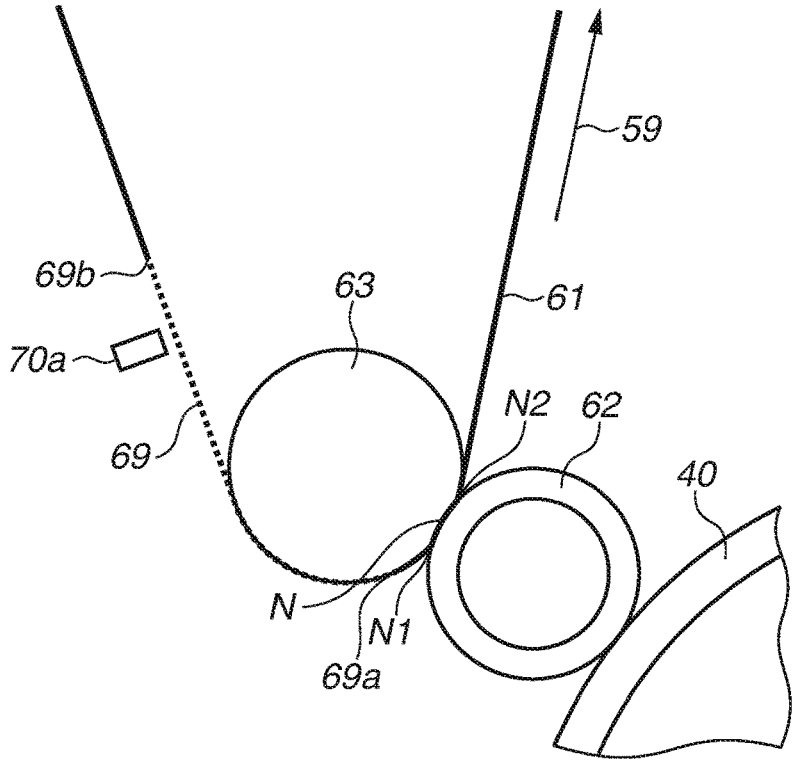

A remaining amount detection sequence according to the present exemplary embodiment will be described with reference to FIGS. 10A, 10B, 11A, 11B, and 12. A detailed description of configurations similar to those of the first exemplary embodiment will be omitted. In FIG. 10A, the flag portion 70*a* falls into the cutout 69 of the web 61 in the direction of the arrow a, whereby the remaining amount advance notice detection of the web 61 is performed as illustrated in FIGS. 5A and 5B. To perform the normal cleaning web sequence even after the detection of the cutout 69 of the web 61, the web feed motor 210 (FIG. 8) continues to be rotated a predetermined number of rotations (R2 rotations) (FIG. 10B). In the meantime, the print job is not stopped but continued.

Figure 11A:
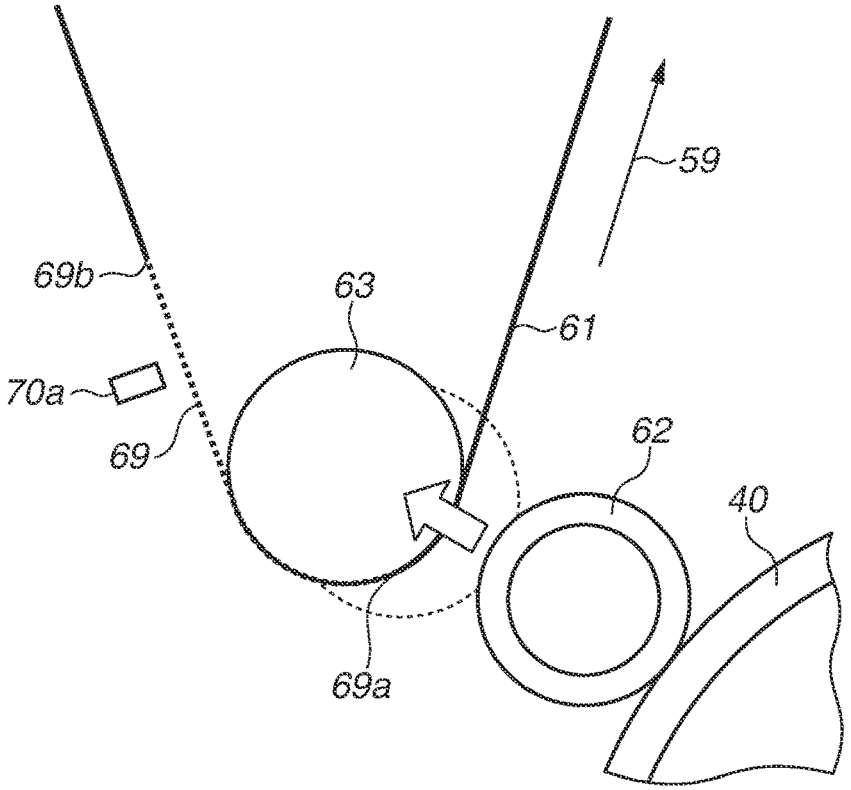
FIGS. 11A and 11B are diagrams for describing the web attaching and detaching operation according to the second exemplary embodiment of the subject disclosure.

In the present exemplary embodiment, the number of rotations R2 of the web feed motor 210 is equivalent to a cleaning web feed amount of 40 mm which moves the front end 69*a* of the cutout 96 from the position of the remaining amount detection to the position immediately before the inlet N1 of the nip portion N. If the web feed motor 210 completes rotating as many times as the number of rotations R2, the print job is stopped. In the web unit 60, the web attaching and detaching motor 209 (FIG. 8) is then rotated to rotate the attaching and detaching cam 91, whereby the web roller 63 and the web 61 are separated from the collection roller 62 (FIG. 11A).

Figure 11B:
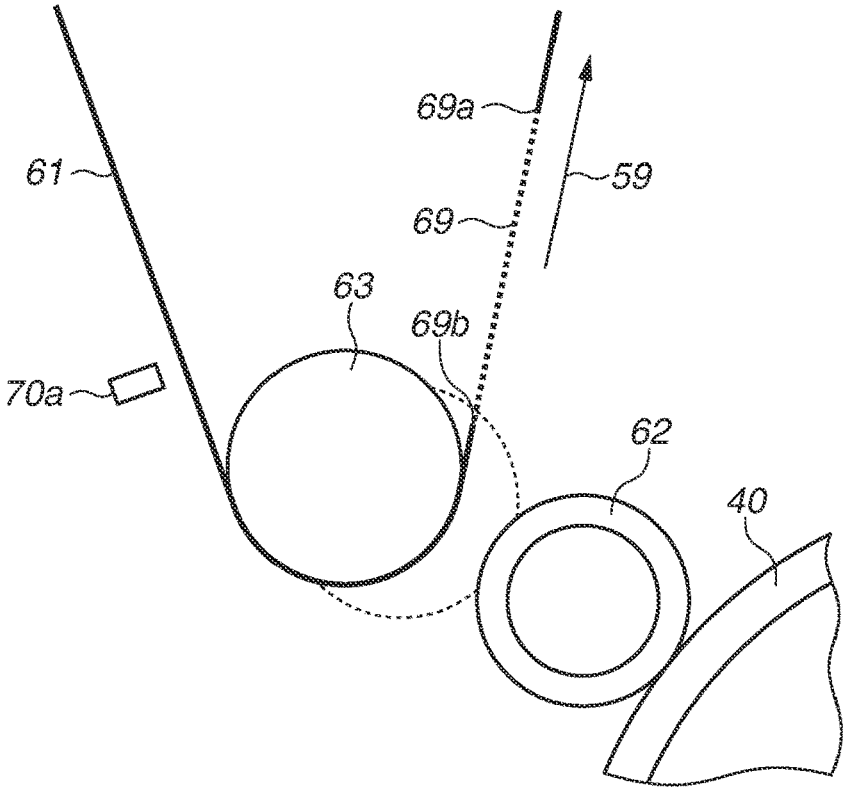
Figure 12:
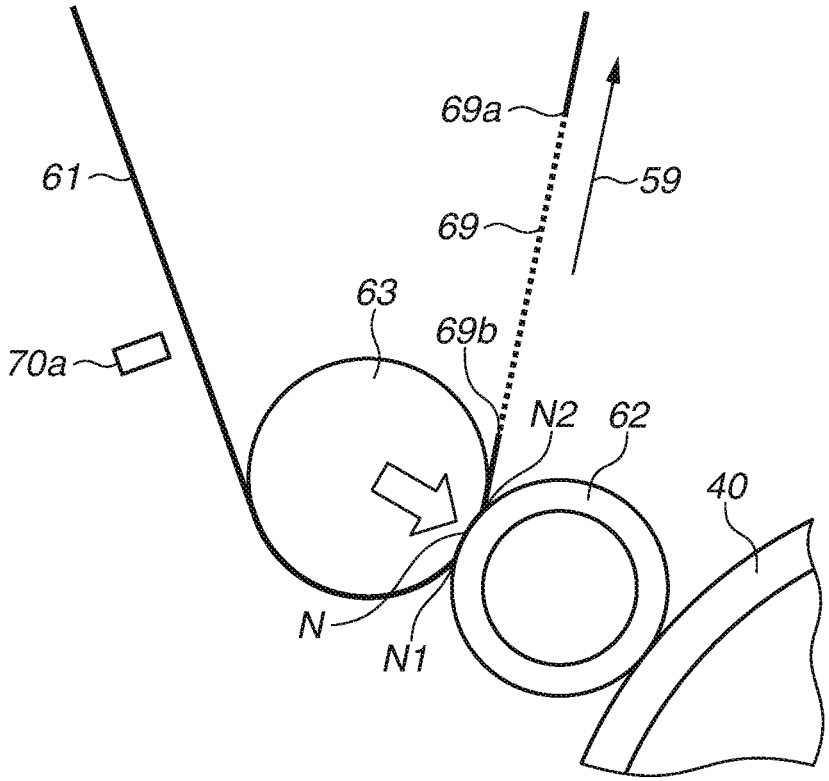
FIG. 12 is a diagram for describing the web attaching and detaching operation according to the second exemplary embodiment of the subject disclosure.

The web feed motor 210 (FIG. 8) is then rotated a predetermined number of rotations (R3 rotations), whereby the rear end 69*b* of the cutout 69 is advanced to a point (position) surely beyond the outlet N2 of the nip portion N formed between the web roller 63 and the collection roller 62 (FIG. 11B). In the present exemplary embodiment, the number of rotations R3 of the web feed motor 210 (FIG. 8) is equivalent to a web feed amount of 60 mm which is needed for the rear end 69*b* of the cutout 69 to surely go beyond the outlet N2 of the nip portion N.

The web attaching and detaching motor 209 (FIG. 8) is then rotated to rotate the attaching and detaching cam 91. The collection roller 62 and the web roller 63 nip the web 61 therebetween in the strong pressure stage (FIG. 12), and the print job is resumed.

Figure 13:
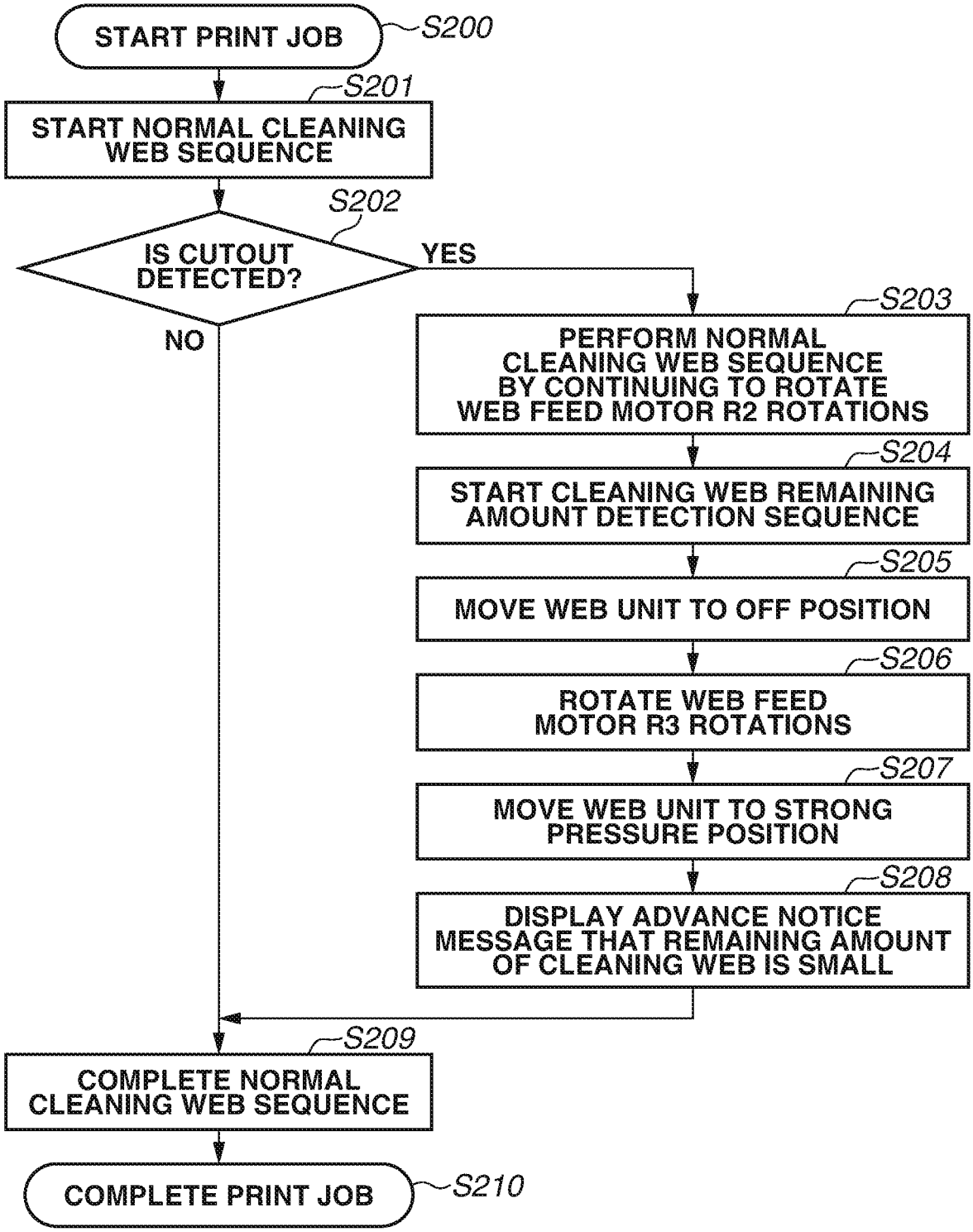
FIG. 13 is a flowchart according to the second exemplary embodiment of the subject disclosure.

FIG. 13 is a flowchart for performing an operation sequence during the cleaning web remaining amount detection (during web remaining amount detection). In step S200, a print job is started. In step S201, the control unit 200 starts the normal cleaning web sequence. The control unit 200 feeds the web 61 while the web 61 cleans toner collected from the fixing roller 40 off the collection roller 62. In step S202, if the cutout 69 of the web 61 is not detected by the remaining amount detection sensor 71 (NO in step S202), the processing proceeds to step S209. In step S209, the control unit 200 continues the normal web sequence until the normal web sequence is completed. In step S210, the control unit 200 completes the print job.

In step S202, if the cutout 69 of the web 61 is detected by the remaining amount detection sensor 71 (YES in step S202), the processing proceeds to step S203. In step S203, the control unit 200 performs the normal cleaning web sequence by continuing to rotate the web feed motor 210 the predetermined number of rotations (R2 rotations). In step S204, after the web feed motor 210 (FIG. 8) is rotated the predetermined number of rotations (R2 rotations), the control unit 200 starts the cleaning remaining amount detection sequence. In step S205, the control unit 200 rotates the web attaching and detaching motor 209 (FIG. 8) to shift the web unit 60 from the strong pressure position (first position) to the off position (second position).

In step S206, the control unit 200 rotates the web feed motor 210 (FIG. 8) R3 rotations. In step S207, the control unit 200 rotates the web attaching and detaching motor 209 (FIG. 8) to shift the web unit 60 from the off position (second position) to the strong pressure position (first position). In step S208, the control unit 200 displays, on the not-illustrated operation unit, the advance notice message that the remaining amount of the web 61 is small. In step S209, the control unit 200 continues the normal cleaning web sequence until the normal cleaning web sequence is completed. In step S210, the print job is completed.

In the present exemplary embodiment, even after the web remaining amount detection flag 70 passes the cutout 69 of the web 61, the print job is not stopped and the normal cleaning web sequence is continued until the front end 69*a* of the cutout 69 reaches the inlet N1 of the nip portion N. This can reduce the time during which the web unit 60 is separated from the collection roller 62 to let the cutout 69 of the web 61 pass the nip portion N. The time during which the print job is stopped for the sake of the web remaining amount detection sequence can thus be reduced to a minimum needed.

The web roller 63 and the collection roller 62 are separated, and the web 61 is advanced until the cutout 69 of the web 61 passes the nip portion N. After the rear end 69*b* of the cutout 69 passes the nip portion N, the web 61 is brought into contact with the collection roller 62 again. This can suppress a rip starting at the cutout 69. As a result, desired cleaning performance can be provided.

In the present exemplary embodiment, the cutout 69 of the web 61 is described to be advanced by a predetermined amount with the web 61 separated. However, the occurrence of a rip can be similarly suppressed by bringing the web 61 into the light pressure state. That is, a sequence for bringing the web 61 into the light pressure state may be employed instead of separating the web 61.

In other words, to change the degree of pressing, the relative position between the web roller 63 and the collection roller 62 may be changeable between the first position where the pressing force (strong pressure) for the web 61 to remove an adhering substance is produced and the second position where the pressing force is weaker (light pressure) than that at the first position or the pressing force is zero (separated).

Next, a third exemplary embodiment of the present disclosure will be described. In the first and second exemplary embodiments, the flag portion 70*a* of the web remaining amount detection flag 70 is arranged upstream of the web roller 63 (upstream of the nip portion N) in the web feeding direction. In the present exemplary embodiment, the flag portion 70*a* is arranged downstream. A cleaning web remaining amount detection sequence according to the present exemplary embodiment will be descried with reference to FIGS. 14A, 14B, 15A, and 15B. A detailed description of configurations similar to those of the first and second exemplary embodiments will be omitted.

Figure 14A:
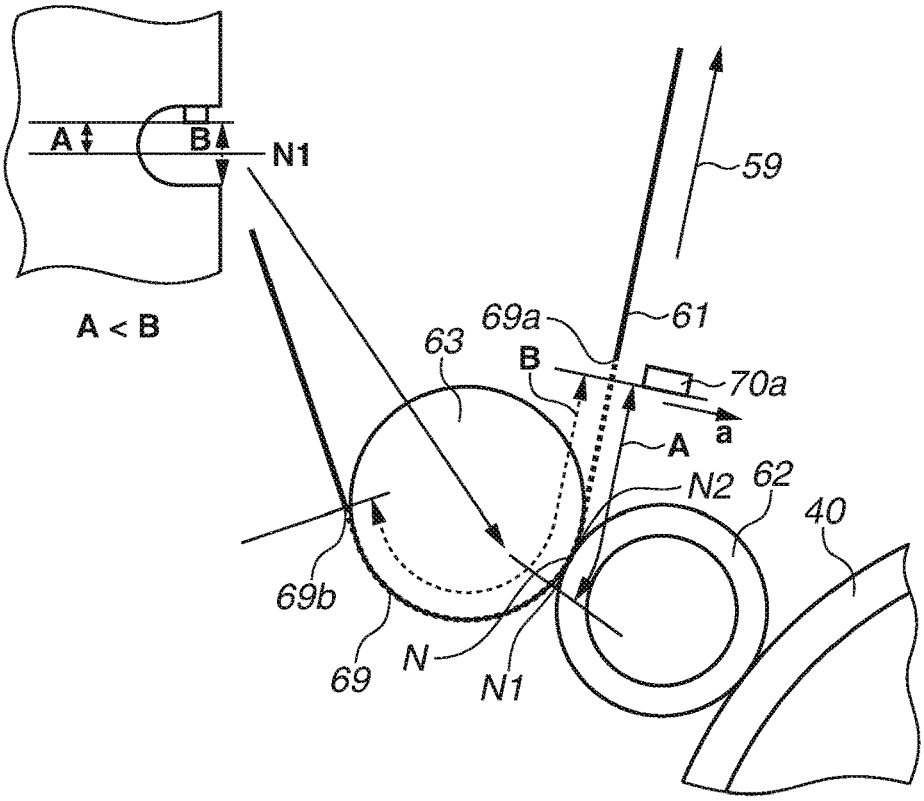
FIGS. 14A and 14B are diagrams for describing a web attaching and detaching operation according to a third exemplary embodiment of the subject disclosure.

In the present exemplary embodiment, as illustrated in FIG. 14A, suppose that the length from the detection position of the flag portion 70*a* (position where the flag portion 70*a* is arranged in a state before a fall of the web remaining amount detection flag 70 in the cleaning apparatus) to the inlet N1, or upstream end, of the nip portion N in the feeding direction of the web 61 (the direction of the arrow 59) is A. Suppose also that the length from the detection position of the flag portion 70*a* in the cutout 69 (the position of the cutout 69 corresponding to the flag-falling position of the flag portion 70*a*) to the rear end 69*b* of the cutout 69 in the feeding direction of the web 61 (the direction of the arrow 59) in the cutout 69 is B. The detection position of the flag portion 70*a* in the cutout 69 refers to the position where the cutout 69 is detected by the flag portion 70*a*. The size of the cutout 69 is set to satisfy the relationship A<B.

Figure 14B:
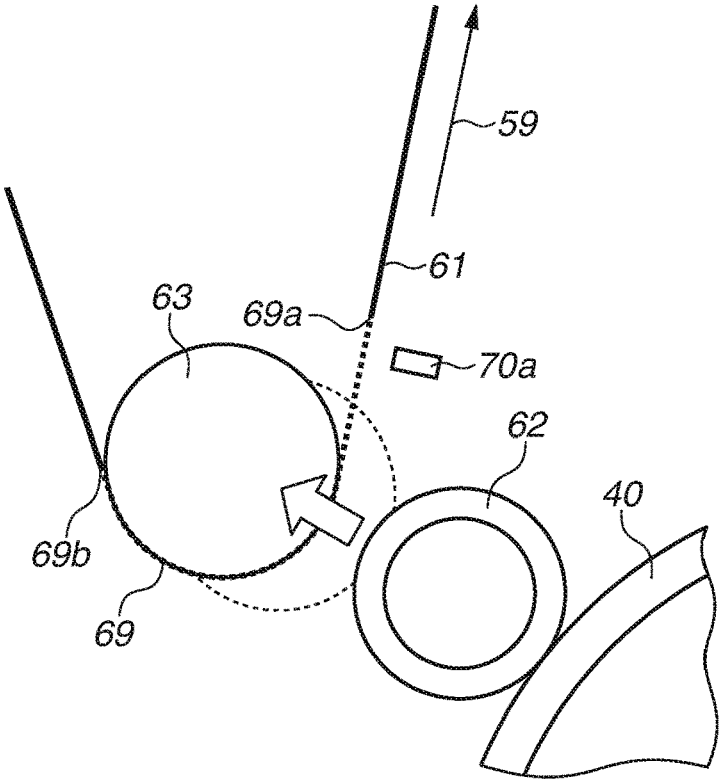

If the foregoing relationship holds, as illustrated in FIGS. 14A and 14B, the rear end 69*b* of the cutout 69 is yet to reach the inlet N1 of the nip portion N when the flag portion 70*a* falls in the direction of the arrow a and the remaining amount detection sensor 71 performs the remaining amount advance notice detection of the web 61. Since the rear end 69*b* of the cutout 69 of the web 61 is not nipped, the web 61 will not be folded or ripped.

After the remaining amount advance notice detection by the cutout 69 of the web 61 in the state of FIG. 14A, the print job is stopped and the web attaching and detaching motor 209 (FIG. 8) is rotated to rotate the attaching and detaching cam 91 (FIGS. 3A and 3B). The web roller 63 and the web 61 are thereby separated from the collection roller 62 (FIG. 14B).

Figure 15A:
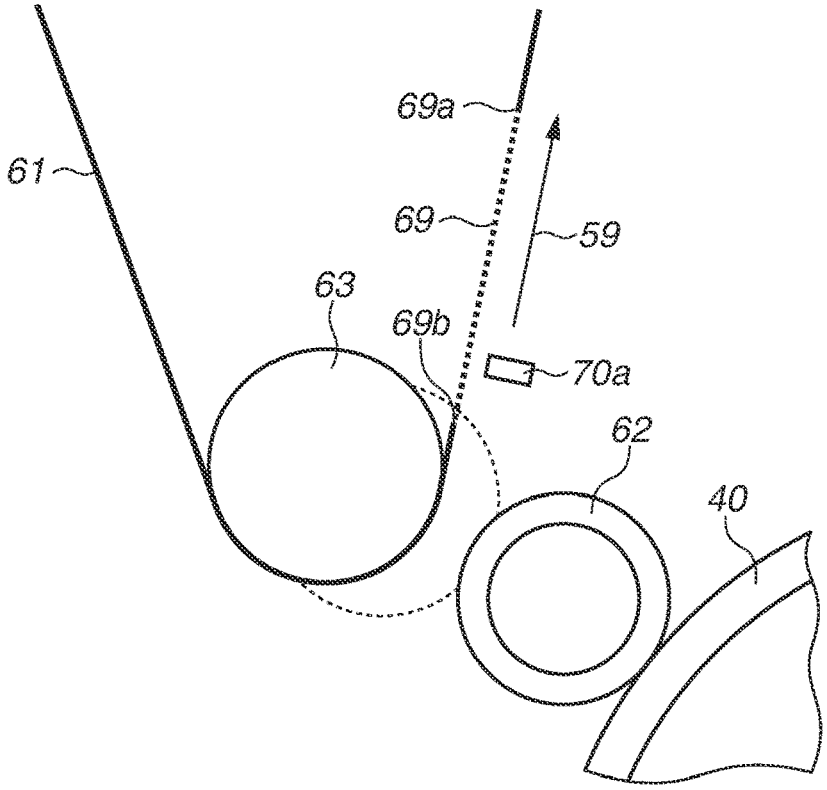
FIGS. 15A and 15B are diagrams for describing the web attaching and detaching operation according to the third exemplary embodiment of the subject disclosure.
Figure 15B:
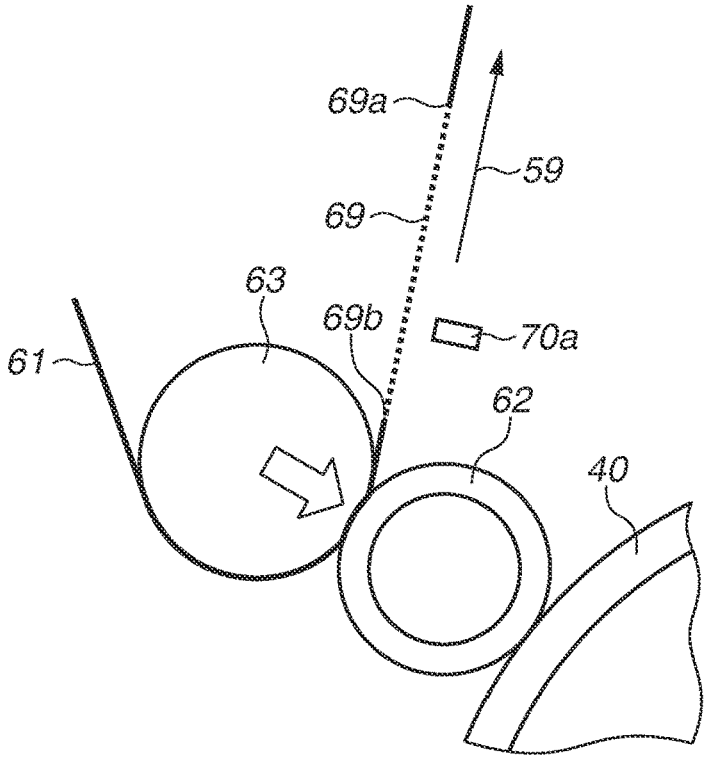

The web feed motor 210 (FIG. 8) is then rotated a predetermined number of times (R4 rotations) to advance the web 61 to a position where the rear end 69*b* of the cutout 69 of the web 61 surely goes beyond the outlet N2 of the nip portion N between the web roller 63 and the collection roller 62 (FIG. 15A). In the present exemplary embodiment, the number of rotations R4 of the web feed motor 210 (FIG. 8) is equivalent to a web feed amount of 35 mm which is needed for the rear end 69*b* of the cutout 69 to surely go beyond the outlet N2 of the nip portion N.

The web attaching and detaching motor 209 (FIG. 8) is then rotated to rotate the attaching and detaching cam 91 (FIGS. 3A and 3B). The collection roller 62 and the web roller 63 nip the web 61 therebetween in the strong pressure state (FIG. 15B), and the print job is resumed. The cleaning web remaining amount detection sequence according to the present exemplary embodiment is different from that of the flowchart of FIG. 9 according to the first exemplary embodiment only in that the number of rotations of the web feed motor 210 in step S106 is changed from R1 rotations to R4 rotations. A description using a flowchart will thus be omitted.

The present exemplary embodiment is characterized in that the flag portion 70*a* of the web remaining amount detection flag 70 is arranged downstream of the web roller 63 in the feeding direction of the web 61, and the size of the cutout 69 is set so that the rear end 69*b* of the cutout 69 will not be nipped. This can suppress a rip starting at the cutout 69.

The web roller 63 and the collection roller 62 are separated from each other at the nip portion, and the web 61 is advanced until the cutout 69 passes the nip portion N. After the cutout 69 passes the nip portion N, the web 61 is brought into contact with the collection roller 62 again. This can suppress a rip starting from the cutout 69. As a result, desired cleaning performance can be provided.

In the present exemplary embodiment, the cutout 69 of the web 61 is described to be advanced by a predetermined amount with the web 61 separated. However, the occurrence of a rip can be similarly suppressed by bringing the web 61 into the light pressure state. A sequence for bringing the web 61 into the light pressure state may therefore be employed instead of separating the web 61.

In other words, to change the degree of pressing, the relative position between the web roller 63 and the collection roller 62 may be changeable between the first position where the pressing force (strong pressure) for the web 61 to remove an adhering substance is produced and the second position where the pressing force is weaker (light pressure) than that at the first position or the pressing force is zero (separated).

The exemplary embodiments of the present disclosure have been described above. However, the present disclosure is not limited to such exemplary embodiments, and various changes and modifications may be made without departing from the gist thereof. The configurations and arrangements of the foregoing exemplary embodiments may be appropriately selected and combined to constitute an exemplary embodiment. The dimensions, materials, shapes, and relative arrangements of the components described in the foregoing exemplary embodiments can be modified as appropriate according to the configuration and various conditions of an apparatus to which an exemplary embodiment of the present disclosure is applied.

The web 61 or foreign substance entangled in the web 61 may damage the fixing roller 40 to produce a visible streak in an image. In the foregoing exemplary embodiments, as a countermeasure against such a visible streak, the collection roller 62 is described to be the target to be cleaned by the web 61, i.e., the first rotation member to the surface of which an adhering substance such as toner adheres. However, the present disclosure is not limited thereto. As a first modification, the fixing roller 40 may be the target to be cleaned by the web 61, i.e., the first rotation member to the surface of which an adhering substance such as toner adheres. In other words, the fixing roller 40 may be directly cleaned by the web 61.

In the foregoing exemplary embodiments, the fixing roller 40 serving as a rotation member is described to be pressed by the pressure roller 41 serving as an opposed member. However, the present disclosure is not limited thereto. As a second modification, an exemplary embodiment of the present disclosure may be similarly applied to an opposite case where the opposed member is pressed by the fixing roller 40.

The foregoing exemplary embodiments have been described by using the fixing apparatus 9 for fixing an unfixed toner image to a sheet as an example. However, the present disclosure is not limited thereto. As a third modification, an exemplary embodiment of the present disclosure may be similarly applied to an apparatus that applies heat and pressure to a toner image temporarily fixed to a sheet to improve glossiness of an image (even in such a case, referred to as a fixing apparatus).

In the foregoing exemplary embodiments, the recording material P is described to be a sheet (recording sheet). However, the recording material P according to an exemplary embodiment of the present disclosure is not limited to paper. In general, a recording material refers to a sheet-like member on which a toner image is formed by an image forming apparatus. As a fourth modification, examples of the recording material P may include standard- and nonstandard-shaped sheets of plain paper, thick paper, thin paper, an envelope, a postcard, a sticker, a resin sheet, an overhead projector (OHP) sheet, and glossy paper. In the foregoing exemplary embodiments, for the sake of convenience, the handling of the recording material P is described in terms of feeding and passing of paper. However, the recording material according to an exemplary embodiment of the present disclosure is not thereby limited to paper.

In the foregoing exemplary embodiment, to displace the web roller 63 in the direction of the arrow 64 (FIG. 2), the image forming apparatus 100 is described to move the web roller 63. However, if the image forming apparatus 100 includes the collection roller 62, the pressing degree change unit including the attaching and detaching cam 91 may move the collection roller 62. In other words, the collection roller 62 moves to switch between the contact, separated, and light pressure states of the collection roller 62 and the web 61. As a fifth modification, the collection roller 62 is separated from both the web 61 and the fixing roller 40 in the separated state.

In the light pressure state, the collection roller 62 makes contact with both the web 61 and the fixing roller 40, and the load (force) acting on the nip portion N is smaller than in the strong pressure state. In the strong pressure state, the collection roller 62 makes contact with both the web 61 and the fixing roller 40, and the load (force) acting on the nip portion N is large.

In the foregoing exemplary embodiments, either the collection roller 62 or the web 61 is described to make contact with the fixing roller 40. As a sixth modification, an exemplary embodiment of present disclosure may be applied to the following configurations. For example, the collection roller 62 may make contact with the pressure roller 41. In another example, the web 61 may make contact with the pressure roller 41.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Applications No. 2017-064732, filed Mar. 29, 2017, and No. 2018-007936, filed Jan. 22, 2018, which are hereby incorporated by reference herein in their entirety.

What is claimed is:

1. A cleaning apparatus comprising:

a rotation member;

a cleaning web configured to remove toner adhering to the rotation member, the cleaning web including a recessed portion in at least a part thereof, wherein the recessed portion includes a front end and a rear end, wherein the rear end is upstream of the front end in a moving direction of the cleaning web;

a rotatable pressure member configured to press the cleaning web toward the rotation member;

a moving mechanism configured to move the cleaning web so that the cleaning web is moved between the rotation member and the rotatable pressure member;

a detection unit configured to detect a position of the recessed portion; and a displacement mechanism configured to situate a relative position between the rotation member and the rotatable pressure member at a first position, where the rotation member and the rotatable pressure member form a nip portion between the rotation member and the rotatable pressure member, and at a second position, where the rotation member and the rotatable pressure member are farther from each other than at the first position such that the rotation member and the rotatable pressure member do not form the nip portion between the rotation member and the rotatable pressure member, wherein the displacement mechanism is configured to situate the relative position based on an output of the detection unit so that the rear end of the recessed portion of the cleaning web passes the nip portion while the rotation member and the rotatable pressure member are situated in the second position, and the relative position is switched to the first position after the rear end of the recessed portion of the cleaning web has passed the nip portion.

2. The cleaning apparatus according to claim 1, further comprising a notification unit configured to make a notification about a remaining amount of the cleaning web in a case where the detection unit detects that the recessed portion has reached a predetermined position.

3. The cleaning apparatus according to claim 1, wherein the displacement mechanism is configured to situate the relative position at the second position in a case where the detection unit detects that the front end of the recessed portion has reached a predetermined position.

4. The cleaning apparatus according to claim 1, wherein the detection unit is arranged upstream of the nip portion in the moving direction of the cleaning web.

5. The cleaning apparatus according to claim 1, wherein the detection unit is arranged downstream of the nip portion in the moving direction of the cleaning web, and wherein a relationship $A < B$ is satisfied, where A is a length from a detection position of the detection unit to an upstream end of the nip portion in a feeding direction of the cleaning web, and B is a length from the front end of the recessed portion to the rear end of the recessed portion in the feeding direction of the cleaning web.

6. The cleaning apparatus according to claim 1, wherein the moving mechanism includes:

a supply roller around which the cleaning web to be supplied to the nip portion is wound;

a winding-up roller configured to wind up the cleaning web supplied to the nip portion; and a motor configured to convey the cleaning web from the supply roller to the winding-up roller.

7. The cleaning apparatus according to claim 1, wherein the rotation member is in contact with either one of second and third rotation members configured to form a fixing nip portion for fixing a toner image to a recording material.

8. The cleaning apparatus according to claim 1, wherein the rotation member is configured to form, in cooperation with a second rotation member, a fixing nip portion for fixing a toner image to a recording material.

9. A fixing apparatus comprising:

first and second rotation members configured to form a first nip portion for fixing a toner image to a recording material;

a third rotation member configured to make contact with the first rotation member;

a cleaning web configured to remove toner adhering to the third rotation member, the cleaning web including a recessed portion in at least part thereof, wherein the recessed portion includes a front end and a rear end, wherein the rear end is upstream of the front end in a moving direction of the cleaning web;

a rotatable pressure member configured to press the cleaning web toward the third rotation member;

a moving mechanism configured to move the cleaning web so that the cleaning web is moved between the third rotation member and the rotatable pressure member;

a detection unit configured to detect a position of the recessed portion; and a displacement mechanism configured to situate a relative position between the third rotation member and the rotatable pressure member at a first position, where the third rotation member and the rotatable pressure member form a second nip portion between the third rotation member and the rotatable pressure member, and at a second position, where the third rotation member and the rotatable pressure member are farther from each other than at the first position such that the third rotation member and the rotatable pressure member do not form the second nip portion between the third rotation member and the rotatable pressure member, and wherein the displacement mechanism is configured to situate the relative position based on an output of the detection unit so that the rear end of the recessed portion of the cleaning web passes the second nip portion while the third rotation member and the rotatable pressure member are situated in the second position, and the relative position is switched to the first position after the rear end of the recessed portion of the cleaning web has passed the second nip portion.

10. The fixing apparatus according to claim 9, further comprising a controller configured to, at least in a case where the detection unit detects that the front end of the recessed portion has reached the predetermined position, suspend conveyance of the recording material so that the recording material does not pass the first nip portion during a predetermined period in which the rear end of the recessed portion moves between the third rotation member and the rotatable pressure member while the third rotation member and the rotatable pressure member are situated in the second position.

11. A cleaning apparatus comprising:

a rotation member;

a cleaning web configured to remove toner adhering to the rotation member, the cleaning web including a recessed portion in at least a part thereof, wherein the recessed portion includes a front end and a rear end, wherein the rear end is upstream of the front end in a moving direction of the cleaning web;

a rotatable pressure member configured to press the cleaning web toward the rotation member;

a moving mechanism configured to move the cleaning web in the moving direction so that the cleaning web is moved between the rotation member and the rotatable pressure member;

a detection unit configured to detect a position of the recessed portion; and a displacement mechanism configured to situate a relative position between the rotation member and the rotatable pressure member to a first position, where the rotation member and the rotatable pressure member form a nip portion and where the rotation member and the rotatable pressure member exert a first force on the nip portion, and to a second position, where the rotation member and the rotatable pressure member form the nip portion and where the rotation member and the rotatable pressure member exert a second force smaller than the first force on the nip portion, wherein the displacement mechanism is configured to situate the relative position from the first position to the second position based on an output of the detection unit such that the rear end of the recessed portion moves through the nip portion while the rotation member and the rotatable pressure member are situated in the second position and to situate the relative position from the second position to the first position based on an output of the detection unit after the rear end of the recessed portion has passed through the nip portion.

12. The cleaning apparatus according to claim 11, further comprising a notification unit configured to make a notification about a remaining amount of the cleaning web in a case where the detection unit detects that the recessed portion has reached a predetermined position.

13. The cleaning apparatus according to claim 11, wherein the displacement mechanism is configured to situate the relative position to the second position in a case where the detection unit detects that the recessed portion has reached a predetermined position.

14. The cleaning apparatus according to claim 11, wherein the rotation member is in contact with either one of second and third rotation members configured to form a fixing nip portion for fixing a toner image to a recording material.

15. The cleaning apparatus according to claim 11, wherein the detection unit is located downstream of the nip portion in the moving direction of the cleaning web, wherein the displacement mechanism is configured to situate the relative position to the first position while the front end of the recessed portion moves through the nip portion, and wherein the detection unit outputs the output in a case where the detection unit detects that the front end of the recessed portion has moved through the nip portion and has reached a predetermined position downstream of the nip portion in the moving direction.

16. A fixing apparatus comprising:

first and second rotation members configured to form a first nip portion for fixing a toner image to a recording material;

a third rotation member configured to make contact with the first rotation member;

a cleaning web configured to remove toner adhering to the third rotation member, the cleaning web including a recessed portion in at least a part thereof, wherein the recessed portion includes a front end and a rear end, wherein the rear end is upstream of the front end in a moving direction of the cleaning web;

a rotatable pressure member configured to press the cleaning web toward the third rotation member;

a moving mechanism configured to move the cleaning web in the moving direction so that the cleaning web is moved between the third rotation member and the rotatable pressure member;

a detection unit configured to detect a position of the recessed portion; and a displacement mechanism configured to situate a relative position between the third rotation member and the rotatable pressure member to a first position, where the third rotation member and the rotatable pressure member form a second nip portion and where the third rotation member and the rotatable pressure member exert a first force on the second nip portion, and to a second position, where the third rotation member and the rotatable pressure member form the second nip portion and where the third rotation member and the rotatable pressure member exert a second force smaller than the first force on the second nip portion, wherein the displacement mechanism is configured to situate the relative position from the first position to the second position based on an output of the detection unit such that the rear end of the recessed portion moves through the second nip portion while the third rotation member and the rotatable pressure member are situated in the second position and to situate the relative position from the second position to the first position based on an output of the detection unit after the rear end of the recessed portion has passed through the second nip portion.

17. The fixing apparatus according to claim 16, wherein the displacement mechanism is configured to situate the relative position to the second position in a case where the detection unit detects that the recessed portion has reached a predetermined position.

18. The fixing apparatus according to claim 16, further comprising a controller configured to, at least in a case where the detection unit detects that the recessed portion has reached a predetermined position, suspend conveyance of the recording material so that the recording material does not pass the first nip portion during a predetermined period in which the rear end of the recessed portion moves through the second nip portion while the third rotation member and the rotatable pressure member are situated to the second position.

* * * * *